US006824083B2

(12) United States Patent
Okuda et al.

(10) Patent No.: US 6,824,083 B2
(45) Date of Patent: Nov. 30, 2004

(54) FLUID JETTING DEVICE, FLUID JETTING HEAD, AND FLUID JETTING APPARATUS

(75) Inventors: Masakazu Okuda, Kanagawa (JP); Kazuhiko Hayashi, Tokyo (JP); Torahiko Kanda, Kanagawa (JP); Yoshihiro Hagiwara, Saitama (JP); Fuminori Takizawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 198 days.

(21) Appl. No.: 10/166,045

(22) Filed: Jun. 11, 2002

(65) Prior Publication Data

US 2003/0085307 A1 May 8, 2003

(30) Foreign Application Priority Data

Jun. 12, 2001 (JP) ..... P.2001-177618
Jun. 27, 2001 (JP) ..... P.2001-194346

(51) Int. Cl.[7] ..... B05B 1/14

(52) U.S. Cl. ..... 239/548; 239/102.1; 239/552; 239/553; 239/552.3; 239/589; 239/590

(58) Field of Search ..... 239/102.1, 102.2, 239/548, 552, 553, 553.3, 553.5, 556, 557, 565, 566, 589, 590, 590.3, 590.5; 347/40, 47, 54

(56) References Cited

U.S. PATENT DOCUMENTS 5,757,400 A 5/1998 Hoisington
6,126,339 A * 10/2000 Kobayashi ..... 396/626
6,488,355 B2 * 12/2002 Nakamura et al. ..... 347/40
6,502,921 B2 * 1/2003 Kanda et al. ..... 347/40

FOREIGN PATENT DOCUMENTS

JP 4-148936 5/1992

* cited by examiner

*Primary Examiner*—Robin O. Evans
(74) *Attorney, Agent, or Firm*—Morgan, Lewis & Bockius, LLP

(57) ABSTRACT

A fluid jetting device is comprised of: a plurality of chambers arranged in a matrix form; nozzles formed in the plural chambers, respectively; a fluid pressure applying portion arranged on at least one planes of the plural chambers; a plurality of fluid pool sub-streams for supplying fluids to the plural chambers; a fluid pool main stream connected to one edges of the plural fluid pool sub-streams; and a fluid supplying portion for supplying a predetermined fluid to the fluid pool main stream. The fluid supplying portion is connected to a portion of the fluid pool main stream in the vicinity of this fluid pool main stream along a longitudinal direction thereof.

19 Claims, 24 Drawing Sheets

FLUID JETTING DEVICE, FLUID JETTING HEAD, AND FLUID JETTING APPARATUS

BACKGROUND OF THE INVENTION

1. Filed of the Invention

The present invention is related to a fluid jetting device for jetting/applying a fluid via a nozzle onto a subject, related to a fluid jetting head containing the fluid jetting device, and also, related to a fluid jetting apparatus containing the fluid jetting head, for jetting/applying a predetermined amount of fluids at a predetermined position.

2. Description of the Related Art

As techniques related to fluid jetting devices, fluid jetting heads, and fluid jetting apparatus, both ink jetting heads in which printing ink is used as fluids to be jetted/applied and printing apparatus containing such ink jetting heads have been known.

FIG. 19 indicates an ink jetting head disclosed in Japanese Laid-open Patent Application No. Hei-4-148936 as an example of the ink jetting head according to related art (fluid jetting device). The ink jetting head shown in this drawing, owns such a structure that a large number of nozzles 301 are arrayed in a column form, and also, chambers 302 having narrow plane shapes are arrayed in such a manner that these chambers 302 are alternately positioned opposite to each other on both sides with respect to the nozzle columns in order that one edges thereof are located at positions corresponding to the nozzles. Also, supply holes 303 are arranged at other edges of the chambers 302.

While an ink pool 304 which is commonly used for all of these chambers 302 is arranged at a layer which is different from the layer where the chambers 302 are arranged, this ink pool 304 is communicated with the respective chambers 302 via the supply holes 303. An actuator (not shown) is mounted on each of pressure applying plates which form one plane of each of the chambers 302. As to the actuator, a piezoelectric actuator constructed of a piezoelectric element will be explained.

In the ink jetting head shown in FIG. 19, since the above-described actuators are driven, the pressure applying plates are flexed in such a direction along which the volumes of the chambers 302 are reduced. As a result, ink stored in the chambers is compressed and then, ink droplets are jetted from the nozzles 301. Then, the ink jetting head is constructed as follows. After the ink droplets have been jetted, ink is refilled from ink pool sub-streams into the chambers via the supply holes 303 in accordance with such a condition that deformation of the pressure applying plates is recovered to the original shapes thereof so as to be prepared for next ink jetting operation.

Now, a more concrete structure of an ink jetting head will be conceived which may be analogized from the above-described structure shown as the prior art. FIG. 20 indicates one of such head structures which may be conceived from the above-described heads. This drawing is an overall structural diagram for schematically showing a fluid jetting device, and showing arrangements of nozzles 101, ink chambers 102, ink pool sub-streams 105, and an ink pool main stream 106.

In FIG. 20, while chambers 102 in which the nozzles 101 for jetting ink are provided are arranged adjacent to each other, these chambers 102 are connected to the common sub-stream 105. Since plural sets of sub-streams 105 to which the nozzles 101/ink chambers 120 are connected are provided, a matrix may be formed in a minimum unit. Also, the respective sub-streams 105 are connected to the main stream 106, and this main stream 106 is connected to an ink tank (not shown).

Normally, four colors including a black color and predetermined three primary colors are required in color printing operation. To realize color printing operation, as indicated in FIG. 21, four sets of unit devices 90, 91, 92, and 93 are preferably formed in such a manner that these four unit devices 90, 91, 92, 93 for the four colors are arrayed in order that dots having different dots may be easily formed at the substantially same positions. In this case, due to such a necessity that the dots having the plural colors are jet/applied to positions in the vicinity of the same dot position, a scanning direction of these devices is preferably selected to a lateral direction of this drawing within a printer apparatus.

In the structures shown in FIG. 20 and FIG. 21, since a plurality of sub-streams 105 are connected to a single set of a main stream 106, a width 106*w* of the main stream should be made wide so as to reduce a fluid resistance of the main stream 106. This is because if the fluid resistance is not lowered, then a sufficient amount of ink is not supplied to such sub-streams located far from the ink tank (namely, sub-streams located at upper positions in case of example shown in FIG. 20), and thus, a depletion of ink may occur.

However, if the main stream width 106*w* is made wide, then a lateral width 80 of the unit device 100 becomes wide, and therefore, the width of the head becomes wide. Then, when the head becomes large, the weight of this head is increased. Thus, there are such problems that the head can be hardly driven, a size of a printer apparatus which mounts thereon this head is increased, and also, manufacturing cost of this head is increased.

The present invention has been made to solve the above-described problems, and therefore, has an object to provide a fluid jetting device, a fluid jetting head, and a fluid jetting apparatus containing these fluid jetting devices/heads, capable of realizing a head designed for a more compact and lighter printer apparatus.

An other object of the present invention is to provide a fluid jetting devices, a fluid jetting head, and a fluid jetting apparatus containing these fluid jetting device/head, capable of reducing vibrations and noise, which are produced during operation thereof.

SUMMARY OF THE INVENTION

To achieve the above-described objects, according to a first aspect of the invention, there is provided a fluid jetting device for jetting fluid droplets onto a subject to be fluid-jetted, the fluid jetting device having a fluid pool, a plurality of chambers arranged in a matrix form and communicating to the fluid pool, the nozzle for jetting the fluid droplets onto the subject, a fluid supplying portion for supplying the fluid to the fluid pool. The fluid pool includes a first flow path elongating along a first direction and disposed in the vicinity of the fluid supplying portion and a plurality of second flow paths branching off from the first fluid path and elongating in a second direction perpendicular to the first fluid path. The first fluid path is connected to both end portions of each of second fluid paths. The second fluid paths are divided at a substantially center portion thereof.

According to a second aspect of the invention, there is provided a fluid jetting device for jetting fluid droplets onto a subject to be fluid-jetted, the fluid jetting device having a fluid pool, a plurality of chambers arranged in a matrix form and communicating to the fluid pool, the nozzle for jetting the fluid droplets onto the subject, a fluid supplying portion for supplying the fluid to the fluid pool. The fluid pool includes a first flow path elongating along a first direction and disposed in the vicinity of the fluid supplying portion and a plurality of second flow paths branching off from the first fluid path and elongating in a second direction perpendicular to the first fluid path. The first fluid path is connected to both end portions of each of second fluid paths.

According to a third aspect of the invention, there is provided a fluid jetting device for jetting fluid droplets onto a subject to be fluid-jetted, the fluid jetting device having a fluid pool, a plurality of chambers arranged in a matrix form and communicating to the fluid pool, a nozzle formed in each of the plurality of chambers, the nozzle for jetting the fluid droplets onto the subject, a fluid supplying portion for supplying the fluid to the fluid pool, and a plurality of fluid pressure applying portion for driving each of chambers. The fluid pool includes a first flow path elongating along a first direction and disposed in the vicinity of the fluid supplying portion and a plurality of second flow paths branching off from the first fluid path and elongating in a second direction perpendicular to the first fluid path. A ratio "N2/N1" of number "N1" of the chambers arrayed in the first direction to number "N2" of the chambers arrayed in the second direction is not smaller than 1.

DETAILED DESCRIPTION OF THE PREFERRED EMBODIMENTS

Embodiments of the present invention will now be described in detail with reference to accompanying drawings.

Embodiment 1: In Case that Fluid to be Jetted is Printing Ink

First Structural Example

Figure 1:
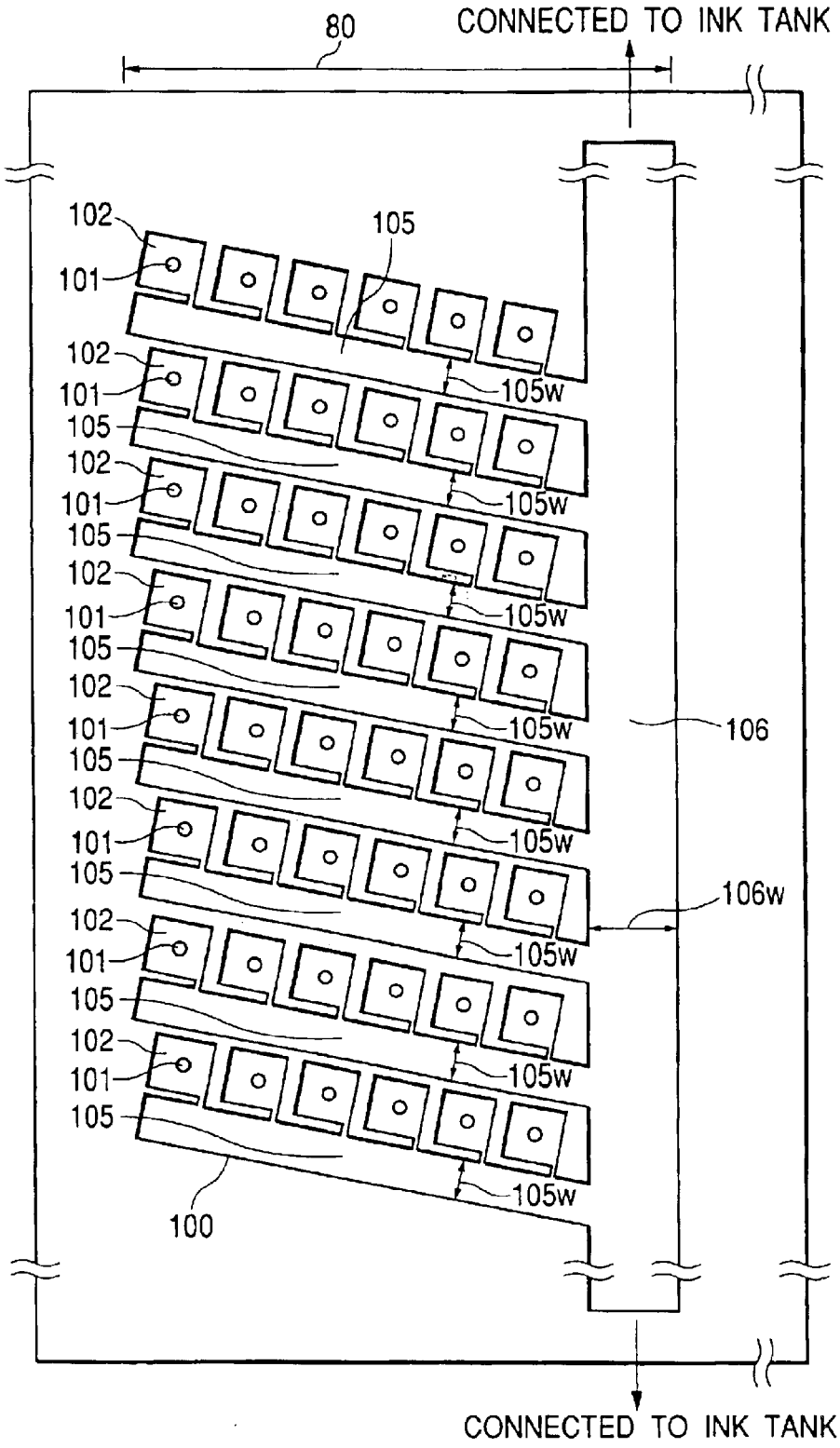
FIG. 1 is a diagram for showing a first structural example of a unit device which constitutes an ink jetting head according to an embodiment 1 of the present invention.

FIG. 1 schematically shows a first upper surface structure of a unit device (namely, fluid jetting device) which constitutes an ink jetting head according to an embodiment 1 of the present invention. In the unit device shown in this drawing, chambers 102 which are built in the ink jetting head and in which nozzles 101 are formed are arranged in a matrix shape, as represented in this drawing. As shown in this drawing, the respective chambers 102 are arranged in such a manner that these chambers 102 are connected to sub-streams 105, while these sub-streams 105 are arranged in such a way that a lateral direction as viewed in this drawing becomes a longitudinal direction.

The respective sub-streams 105 are connected to a main stream 106 as shown in FIG. 1. The main stream 106 is connected via an ink supply port (not shown) to an ink tank (not shown either). In this case, this main stream 106 is connected to the ink tank at two upper/lower places thereof.

The ink which is supplied from the above-described ink tank via the ink supply port and the two upper/lower portions to the main stream 106 flows through the respective sub-streams 105, and the ink flowing through the sub-streams 105 is distributed to the respective chambers 102. Then, pressure is applied to the ink conducted to the respective chambers 102 by pressure applying plates (not shown) arranged at the back of the chambers and further by actuators (not shown) at the back of these pressure applying plates, so that the ink is jetted via the nozzles 101 onto a plane (not shown) located opposite to the unit device 100.

A position from which ink is jetted may be determined by selectively driving which actuator among a plurality of actuators. To this end, wiring lines are connected to the respective actuators, by which voltages are applied to the respective actuators. The wiring lines are connected to a voltage applying source (not shown). The voltage applying source is connected to a control apparatus (not shown) capable of selecting that an actuator of which chamber 102 is driven. The control apparatus controls the voltage applying source based upon data supplied from an external unit of this control apparatus.

It should be noted that the ink jetting head may be constituted in such a manner that while heating elements are employed instead of the above-described pressure applying plates and the above-explained actuators, heat may be applied to ink. In other words, while volume expansion of ink by heat and pressure caused by producing bubbles are utilized, ink may be jetted. Also, in the unit device shown in FIG. 1, such a case is represented that a total number of sub-streams 105 is eight, and a total number of chambers 102 connected to a single sub-stream is six. However, these quantities may be properly selected.

Figure 2:
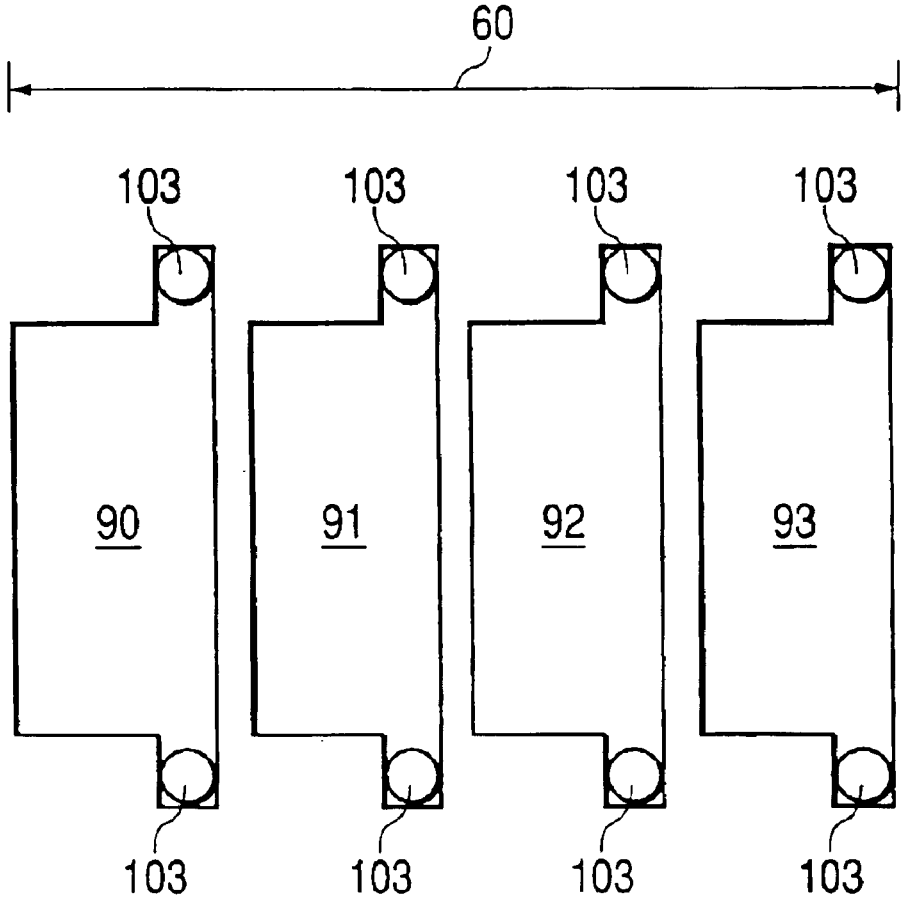
FIG. 2 is a diagram for indicating an array of fluid jetting devices shown in FIG. 1.

FIG. 2 shows an array of the fluid jetting device indicated in FIG. 1. In this case, the devices, which are arrayed in the arrangement shown in this drawing, are employed in the ink jetting head. In other words, while four pieces of unit devices 90, 91, 92, 93 are arrayed, a head main scanning direction corresponds to a lateral direction as viewed on the paper plane. It should also be noted that the unit device 90 corresponds to a unit device for a first color (for example, yellow), the unit device 91 corresponds to a unit device for a second color (for instance, cyan), the unit device 92 corresponds to a unit device for a third color (for example, magenta), and also, the unit device corresponds to a unit device for a fourth color (for instance, black).

In the case of such an example shown in FIG. 2, as previously explained, these unit devices are used for both the three primary colors and the black color, respectively. At this time, due to necessities for jetting/applying dots of plural colors onto places in the vicinity of the same dot position, a scanning direction of these devices is preferably set along a lateral direction in this drawing within a printer apparatus.

Different from the above-described structure of the fluid jetting device according to the related art, as to the structure of the fluid jetting device according to this embodiment 1 indicated in FIG. 1 and FIG. 2, the ink flows from the two upper/lower places of this fluid jetting device into the main stream 106. As a result, a substantial flow path of the ink which flows through the main stream 106 is equal to a half of the length of the main stream 106.

Figure 20:
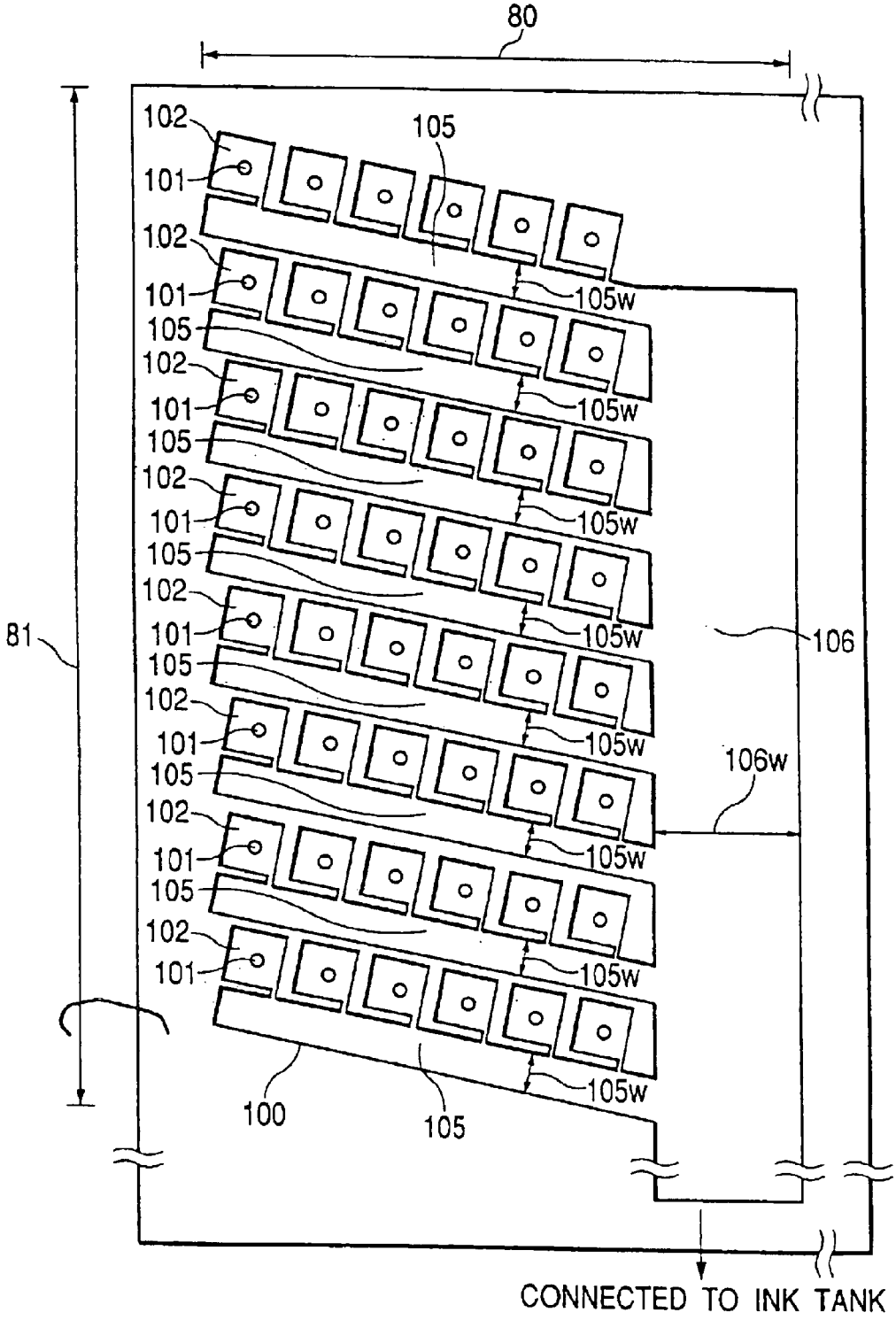
FIG. 20 RELATED ART
FIG. 20 is a diagram for showing the fluid jetting device conceived from the fluid jetting device according to the related art.

Because of this structure, even when a fluid resistance per unit length of the main stream 106 is larger than the fluid resistance of the structure according to the related art (for instance, structure shown in FIG. 20), sufficiently large amounts of ink can be supplied to all of the sub-streams 105. In other words, in the fluid jetting device according to this embodiment 1, the width 106*w* of the main stream 106 can be made narrower than that of the structure according to the related art, and a unit device width 80 and also a head width 60 (see FIG. 2) can be made narrow.

It should also be understood that the main stream 106 is constructed as a single flow path in FIG. 1. Alternatively, the main stream 106 may be divided into two main streams along upper/lower directions. In view of bubble ejecting characteristics achieved with the main stream 106, the above-described two subdivided main streams are preferably employed.

Second Structural Example

FIG. 2 schematically shows a second upper surface structure of a unit device (namely, fluid jetting device) which constitutes an ink jetting head according to the embodiment 1 of the present invention. Also, in the unit device chambers 102 in which nozzles 101 are formed are arranged in a matrix shape, as represented in this drawing. As shown in this drawing, the respective chambers 102 are arranged in such a manner that these chambers 102 are connected to sub-streams 105*a* to 105*h*, while these sub-streams 105*a* to 105*h* are arranged in such a way that a lateral direction as viewed in this drawing becomes a longitudinal direction.

Figure 3:
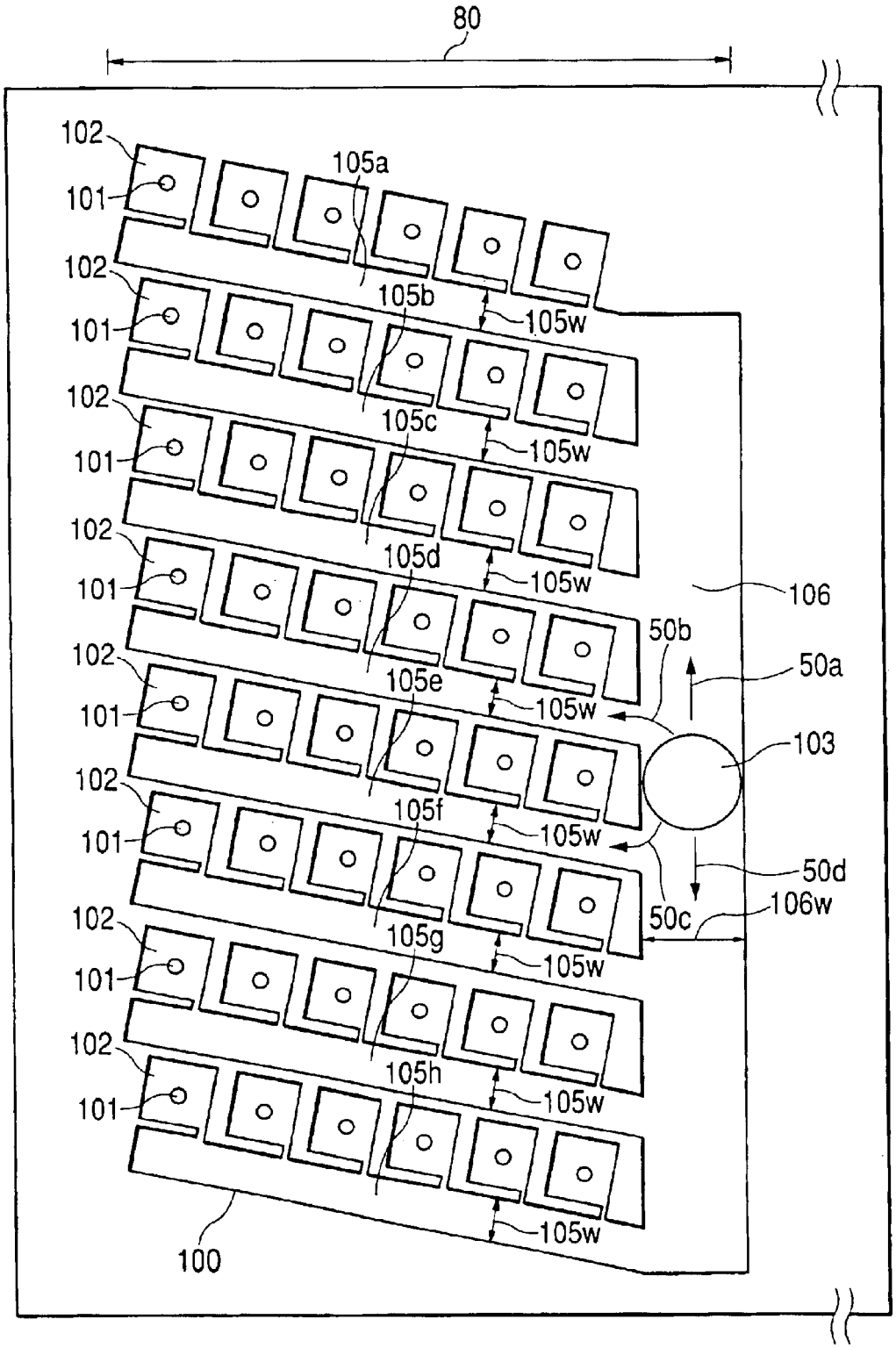
FIG. 3 is a diagram for showing a second structural example of a unit device which constitutes an ink jetting head according to the embodiment 1 of the present invention.

Each of the sub-streams (105*a* etc.) is connected to a main stream 106, as indicated in FIG. 3. The main stream 106 is connected via an ink supply port 103 to an ink tank (not shown). As indicated in FIG. 3, this ink supply port 103 is provided in the vicinity of a center of the main stream 106.

In the structure shown in FIG. 3, ink which is supplied from the ink tank via the ink supply port 103 flows as ink streams 50*b* and 50*c* into sub-streams 105*d* and 105*e* in the vicinity of the ink supply port 103, and also, becomes two streams along opposite directions, called as an ink stream 50*a* of an upper direction and an ink stream 50*e* of a lower direction to constitute the main stream 106. These ink streams flows into the sub-streams 105*a* to 105*c*, and the sub-streams 105*f* to 105*h*. Then, the ink which flows into the respective sub-streams 105*a* to 105*h* is furthermore distributed into the respective chambers 102. Operations subsequent to the above-explaining operations are identical to those in the case of the unit device according to the above-described embodiment 1.

It should be understood that in the example represented in FIG. 3, such a case is represented that a total number of sub-streams 105 is eight, and a total number of chambers 102 connected to a single sub-stream is six. However, these quantities may be properly selected.

Figure 4A:
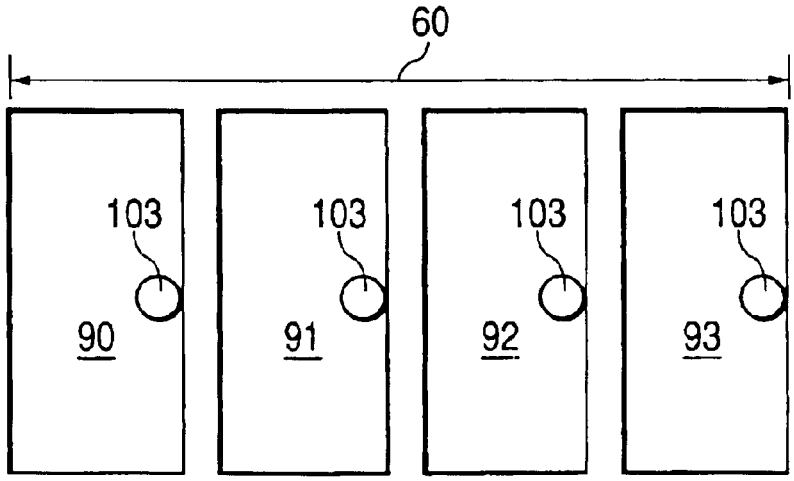
FIG. 4 is a diagram for indicating an array of fluid jetting devices shown in FIG. 3, and a position of a supply port.
Figure 4B:
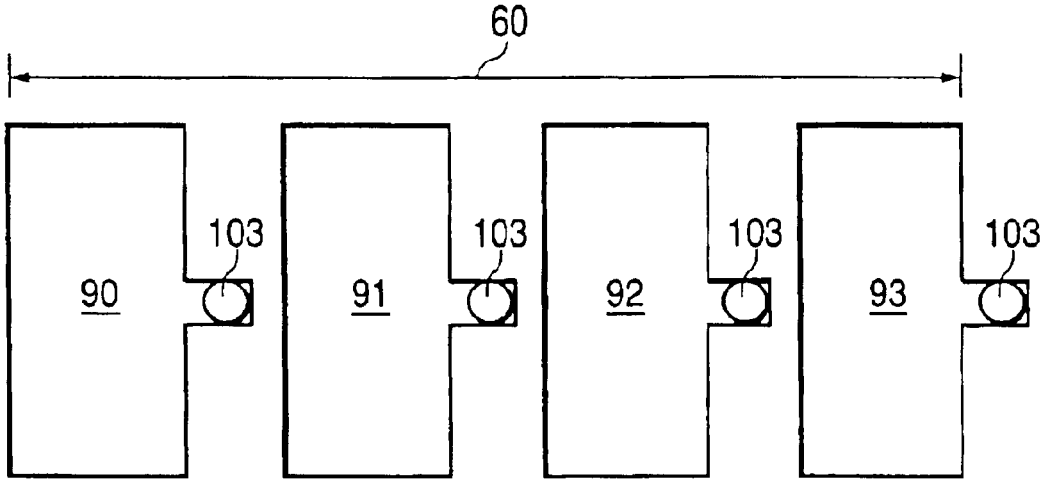

The unit device having the structure shown in FIG. 3 may be employed in a head in which the unit devices are arrayed as indicated in FIG. 4(*a*). A head main scanning direction of this head corresponds to a lateral direction as viewed in a paper plane of this drawing, and four pieces of unit devices 90, 91, 92, 93 are arrayed. In this case, the respective unit devices are employed for the three primary colors and the black color. Also, due to necessities for jetting/applying dots of plural colors onto places in the vicinity of the same dot position, a scanning direction of these devices is preferably set along the lateral direction in this drawing within a printer apparatus.

Different from the above-described structure of the fluid jetting device according to the related art, as to the structure of the unit device according to this second structural example, the ink mainly flows from a center portion of the main stream 106 along two upper and lower directions. As a result, a substantial flow path of the ink which flows through the main stream 106 is equal to a half of the length of the main stream 106. Accordingly, even when a fluid resistance per unit length of the main stream 106 is larger than the fluid resistance of the structure according to the related art (for instance, structure shown in FIG. 20), sufficiently large amounts of ink can be supplied to all of the sub-streams 105.

In other words, a main stream width 106*w* can be made narrower than that of the above described structure according to the related art, and a unit device width 80 and also a head width 60 can be made narrower than those of the structure according to the related art. It should also be noted that as to the above-described structure, when a head is arranged by arraying a plurality of unit devices, the ink supply port 103 is preferably provided on the main stream 106. This reason is given as follows. That is, as shown in FIG. 4(*b*), if the ink supply portion 103 is provided beside the unit devices 90 to 93, then the head width 60 would become wider.

However, in such a case that a head is arranged by employing a single set of the unit device, even when this head has a structure in which ink supply port 103 is provided beside the single unit device, there are some possibilities capable of achieving such a merit that the unit device width 80 can be made narrow.

Third Structural Example

Figure 5:
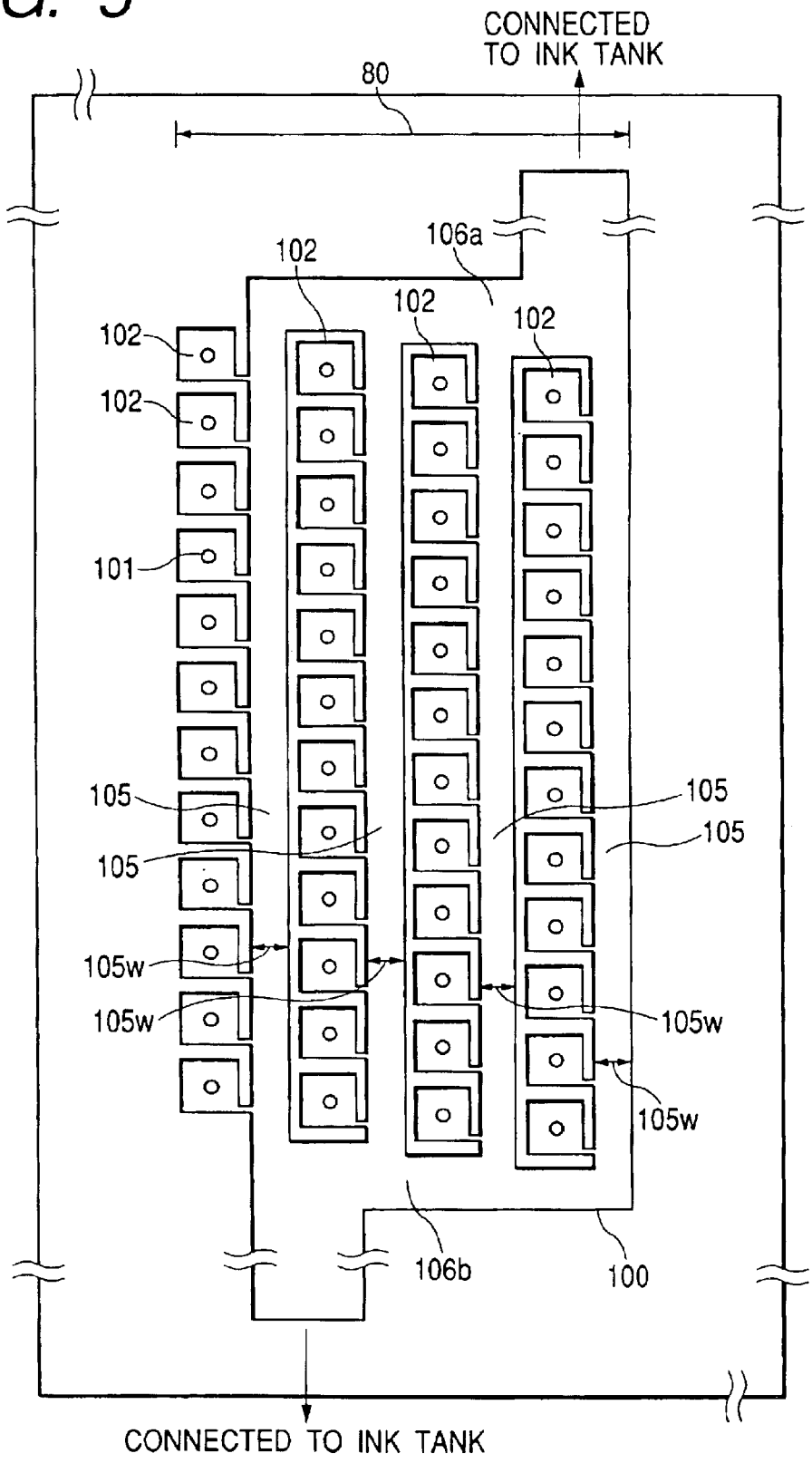
FIG. 5 is a diagram for showing a third structural example of a unit device which constitutes an ink jetting head according to the embodiment 1 of the present invention.

FIG. 5 schematically shows a third upper surface structure of a unit device (namely, fluid jetting device) which constitutes an ink jetting head according to the embodiment 1 of the present invention. Also, in this structure, chambers 102 in which nozzles 101 are formed are arranged in a matrix shape, as represented in this drawing. As shown in this drawing, the respective chambers 102 are arranged in such a manner that these chambers 102 are connected to sub-streams 105, while these sub-streams 105 are arranged in such a way that a longitudinal direction (sub-scanning direction) as viewed in this drawing becomes a longitudinal direction.

As indicated in FIG. 5, each of the plural sub-streams 105 is connected to both an upper main stream 106*a* and a lower main stream 106*b*. In this structural example, the main streams 106 are connected via an ink supply port (not shown) to an ink tank (not shown).

In this structure, ink which is supplied from the above-described ink tank via the ink supply port to both the upper main stream 106*a* and the lower main stream 106*b* flows through these upper/lower main streams 106*a*/106*b*, and then, flows from two upper/lower connection portions between the main streams 106*a*/106*b* and the sub-streams 105 into the respective sub-streams 105. The ink which has flown into the respective sub-streams 105 is furthermore distributed into the respective chambers 102. Operations subsequent to the above-explained operation are the same as those executed in the case of the unit device related to the first structural example as represented in FIG. 1.

It should be understood that in the structural example shown in FIG. 5, such a case is represented that a total number of sub-streams 105 is four, and a total number of chambers 102 connected to a single sub-stream is twelve. However, these quantities may be properly selected.

Figure 6:
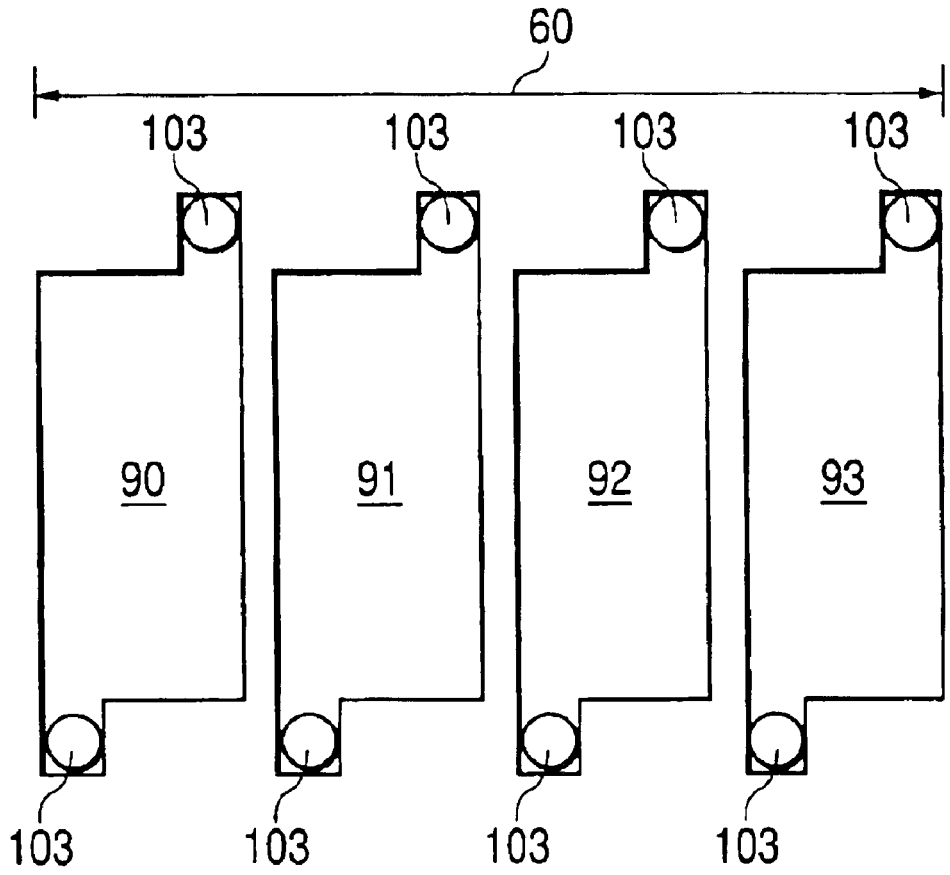
FIG. 6 is a diagram for indicating an array of fluid jetting devices shown in FIG. 5.

The unit device structure shown in FIG. 5 is employed in such a head that these unit device structures are arrayed as an arrangement shown in FIG. 6. A main scanning direction of this head corresponds to a lateral direction as viewed in a paper plane of this drawing, and four pieces of unit devices 90, 91, 92, 93 are arranged. In this case, these unit devices are used for both the three primary colors and the black color, respectively. At this time, due to necessities for jetting/applying dots of plural colors onto places in the vicinity of the same dot position, a scanning direction of these devices is preferably set along a lateral direction in this drawing within a printer apparatus.

Different from the above-described structure of the fluid jetting device according to the related art (for example, structural example shown in FIG. 22), as to the structure of the fluid jetting device indicated in FIG. 5 and FIG. 6, since the ink flows from the two upper/lower places, a substantial flow path of the ink which flows through the respective sub-streams 105 is equal to a half of a length of the sub-stream 105. Because of this structure, even when a fluid resistance per unit length of a sub-stream 105 is larger than the fluid resistance of the structure according to the related art, sufficiently large amounts of ink can be supplied to all of the chambers 102 which are connected to the same sub-stream 105.

In other words, also in the third structural example, the sub-stream width 105w can be made narrower than that of the structure according to the related art. As a result, both the unit device width 80 and the head width 60 of the unit device 100 can be made narrow.

Fourth Structural Example

Figure 22:
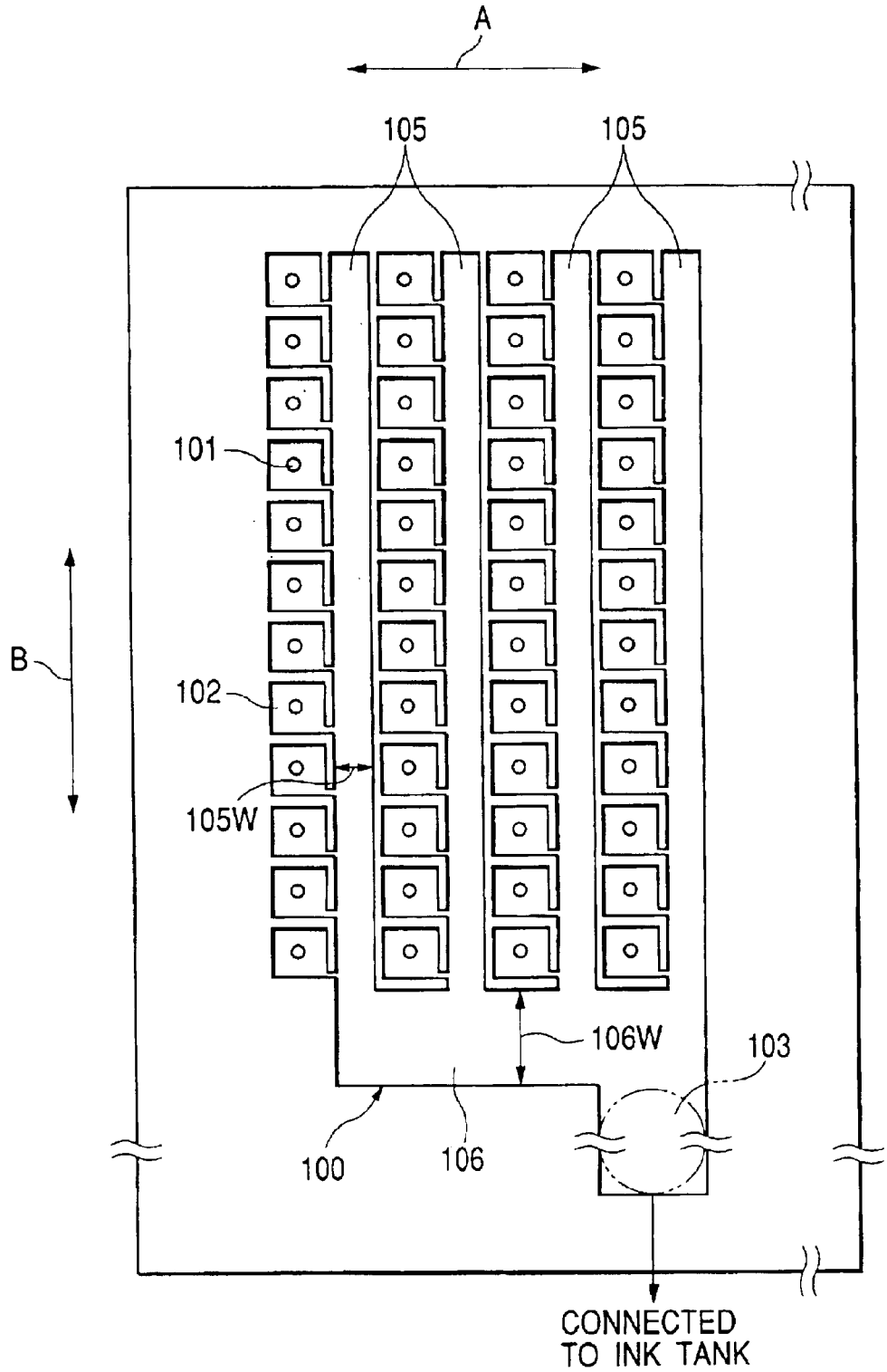
FIG. 22 is a diagram for showing a fourth structural example of a unit device which constitutes an ink jetting head according to the embodiment 1 of the present invention.

FIG. 22 schematically shows a fourth upper surface structure of a unit device (fluid jetting device) which constitutes an ink jetting head according to this embodiment 1.

This fluid jetting device (unit device) 100 includes a large number of nozzles 101, a large number of chambers 102, and a main stream 106. The nozzles 101 are arranged in a matrix shape. The chambers 102 communicate with the respective nozzles 101. The main stream 106 communicates with an ink tank (not shown) via an ink supply port 103. The main stream 106 is elongated in parallel to a scanning direction (namely, head scanning direction) of an ink jetting head (not shown) on which the fluid jetting device 100 is mounted, while this scanning direction is indicated by an arrow "A". An ink pool is provided with the main stream 106 located in proximity to the ink supply port 103. The main stream 106 also includes a plurality of sub-streams 105 which are branched form the main stream 106, respectively, and are elongated along a direction (namely, paper transport direction) which is indicated by an arrow "B" and is intersected perpendicular to the scanning direction "A". The chambers 102, which are communicated to the nozzles 101, are communicated to the respective sub-streams 105.

Concretely speaking, in the fluid jetting device 100, a total number of the above-described sub-streams 105 is four, namely, a total number "N1" of the chambers 102 is four, which are arrayed along the elongated direction of the main stream 106, whereas a total number "N2" of the chambers 102 is twelve, which are arrayed along the elongate direction of the sub-stream 105. A ratio "N2/N1" of these quantities N1 and N2 is equal to 3. These quantities may be properly selected.

Since the ink supply port 103 is arranged in the vicinity of the main stream 106 in the fluid jetting device 100 shown in FIG. 22, when the fluid jetting device 100 is mounted on an ink jetting head, these fluid jetting devices 100 are arrayed as the fluid jetting devices (90 to 93) for the three primary colors and also the black color.

In the fourth structural example, the ink pool is provided with the main stream 106 and the plural sub-streams 105, while the main stream 106 is located in proximity of the ink supply port 103 and also is elongated along the direction parallel to the scanning direction "A", and furthermore, the plural sub-streams 105 are branched from the main stream 106 and also are elongated along the paper transport direction "B" perpendicular to the scanning direction. As a consequence, the ink which is supplied from the ink supply port 103 to the main stream 106 can be smoothly entered into the sub-streams 105 which are elongated from the main stream 106 in the linear manner along the direction perpendicular to this main stream 106. As a result, since the fluid resistance between the sub-streams 105 and the chambers 102 can be reduced, there is no such a problem that the fluid jetting amounts are changed every nozzle 101. Also, the ratio "N2/N1" of the total number "N1" of the chambers 102 which are arrayed in parallel to the scanning direction "A" with respect to the total number "N2" of the chambers 102 which are arrayed along the paper transport direction "B" is set to 3, namely is set to be larger than, or equal to 1. As a consequence, the chambers 102 (nozzles 101) arrayed in the matrix shape may be arrayed in such a manner that the head widths thereof along the scanning direction "A" are made narrow. Accordingly, it is possible to avoid such a fact that the dimension of the ink jetting head is increased.

The ratio of "N2/N1" may be properly set to as arbitrary value larger than, or equal to 1. However, when this ratio of "N2/N1" is set to an excessively large value, the lengths (path resistances) of the sub-streams 105 are increased, and the necessary widths of the sub-streams 105 are increased, so that a compact ink jetting head can be hardly constituted. As a consequence, in order to realize a compact ink jetting head, the ratio of "N2/N1" may be preferably in a range of from 1 to 10.

Fifth Structural Example

Figure 7:
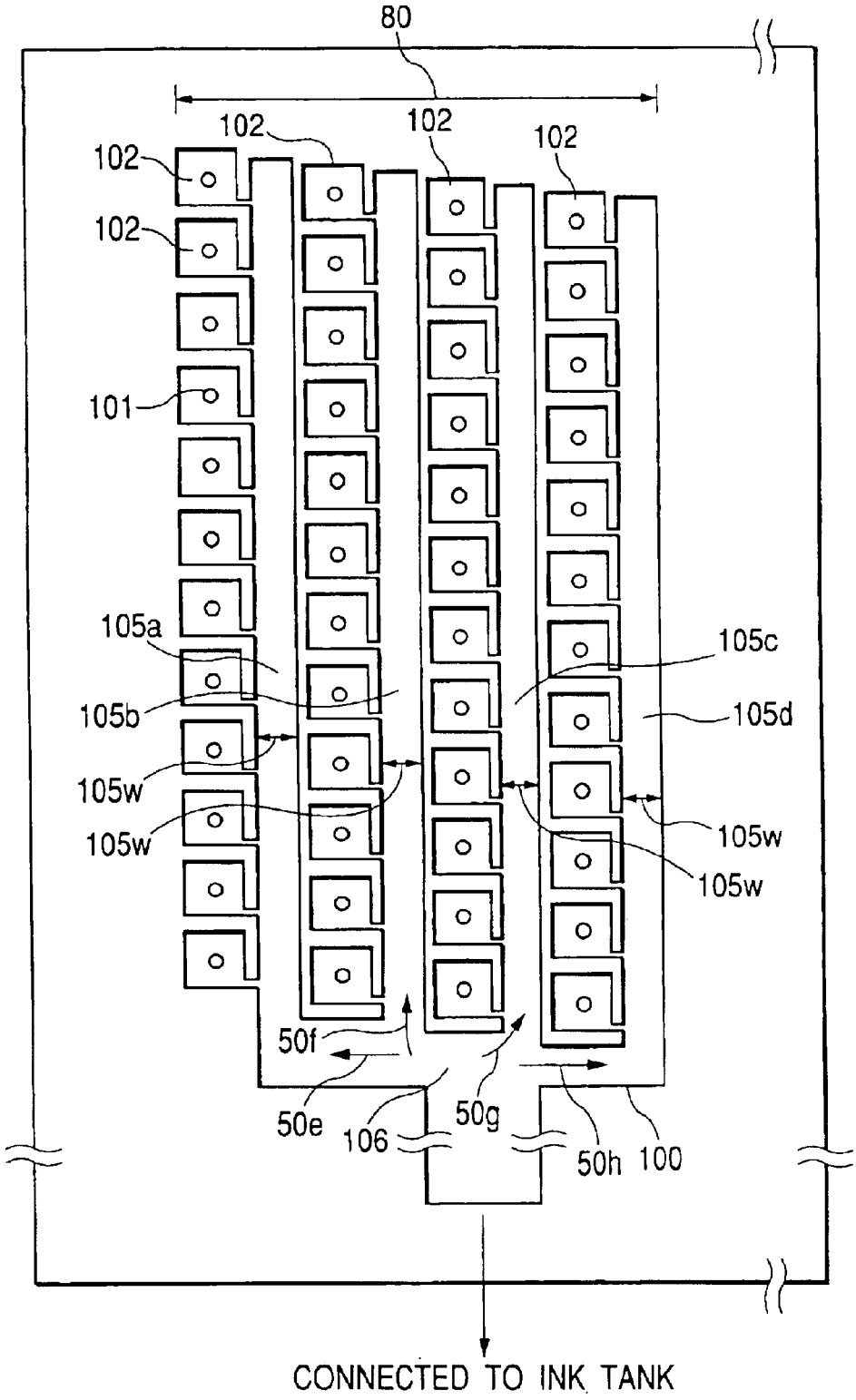
FIG. 7 is a diagram for showing a fifth structural example of a unit device which constitutes an ink jetting head according to the embodiment 1 of the present invention.

FIG. 7 schematically indicates a fifth upper surface structure of a unit device (fluid jetting device) which constitutes an ink jetting head according to the embodiment 1. In the device shown in this drawing, chambers 102 in which nozzles 101 are formed are arrayed in a matrix shape, and the respective chambers 102 are connected to sub-streams (105*a* etc.) which are arranged in such a manner that a longitudinal direction as viewed in a paper plane becomes a longitudinal direction thereof.

The respective sub-streams are connected to a main stream 106 as indicated in FIG. 7, whereas the main stream 106 is connected via an ink supply port (not shown) to an ink tank (not shown either) in the vicinity of a center portion of this main stream 106 along a longitudinal direction thereof.

In the structure shown in FIG. 7, ink which is supplied from the ink tank via the ink supply port flows through the main stream 106, and is entered as ink streams 50*f* and 50*g* into sub-streams 105*b* and 105*c* in the vicinity of a junction point thereof. Also, the ink which is supplied to the main stream 106 produces two ink streams called as an ink stream 50*e* and another ink stream 50*h* along opposite directions, and then, the respective ink streams 50*e* and 50*h* are entered into sub-streams 105*a* and 105*d*, respectively. Then, the ink which flows into the respective sub-streams 105 is furthermore distributed into the respective chambers 102. Operations subsequent to the above-explained operations are identical to those in the case of the unit device according to the above-described embodiment 1.

It should be noted that in the structural example indicated in FIG. 7, such a case is exemplified in that total number of these sub-streams 105 is four, and total number of the chambers 102 which are connected to a single sub-stream is twelve. However, these quantities may be properly selected.

Figure 8:
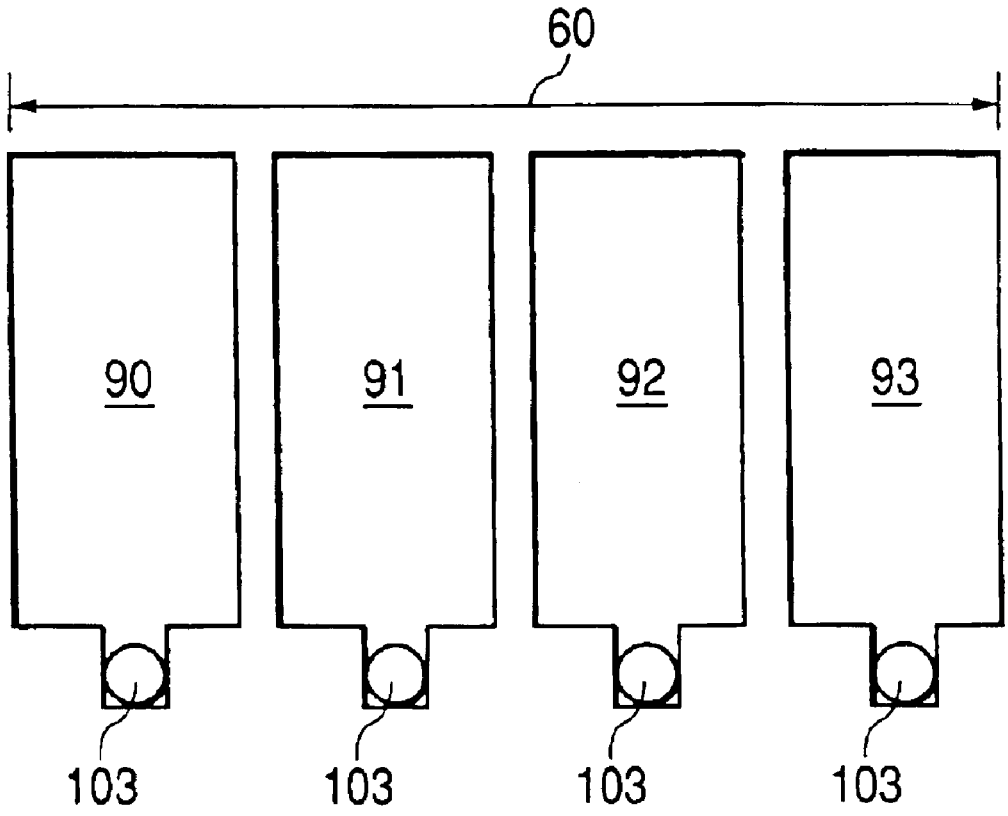
FIG. 8 is a diagram for indicating an array of fluid jetting devices shown in FIG. 7.

The unit device having the structure shown in FIG. 7 may be employed in a head in which the unit devices are arrayed as indicated in FIG. 8. A main scanning direction of this head corresponds to a lateral direction in the drawings, and four pieces of unit devices 90, 91, 92, 93 are arrayed. In this case, these unit devices are used for both the three primary colors and the black color, respectively. At this time, due to necessities for jetting/applying dots of plural colors onto places in the vicinity of the same dot position, a scanning direction of these devices is preferably set along a lateral direction in this drawing within a printer apparatus.

Different from the above-described structure (for example, structure shown in FIG. 22) of the fluid jetting device according to the related art, as to the structure of the fluid jetting device indicated in FIG. 7 and FIG. 8, since the ink is supplied from the portion in the vicinity of the center of the main stream 106, a substantial flow path of the ink which flows through the main stream 106 is equal to a half of the length of the main stream 106. As a consequence, even when a fluid resistance per unit length of the main stream 106 is larger than the fluid resistance of the structure according to the related art, sufficiently large amounts of ink can be supplied to all of the sub-streams 105.

In other words, in the fifth structural example, the width of the main stream 106 can be made narrower than that of the structure according to the related art, and also, the heights of the unit device 100 and of the head can be made lower.

FIG. 7 exemplifies such a case that the width of the main stream 106 is not uniform on right/left sides thereof. Alternatively, according to the present invention, the width of the main stream 106 maybe uniform on the right/left sides thereof. It should also be noted that as shown in FIG. 7, when the width of the main stream 106 is not uniform , the connection portion to the ink tank is preferably shifted from the center portion of the main stream 106 to the narrower side (right side in FIG. 7) of the main stream 106. This reason is given as follows: That is, when the width of the main stream 106 is narrow, the fluid resistance per unit length is large. Therefore, the flow path is shortened by arraying the connection portion to the ink tank in the above-described manner, which reduces the fluid resistance.

It should also be understood that the unit device structures shown in FIG. 7 and FIG. 8 may constitute very effective structures in the case that the heights of the unit device 100 and of the head are desired to be made lower.

Sixth Structural Example

Figure 23:
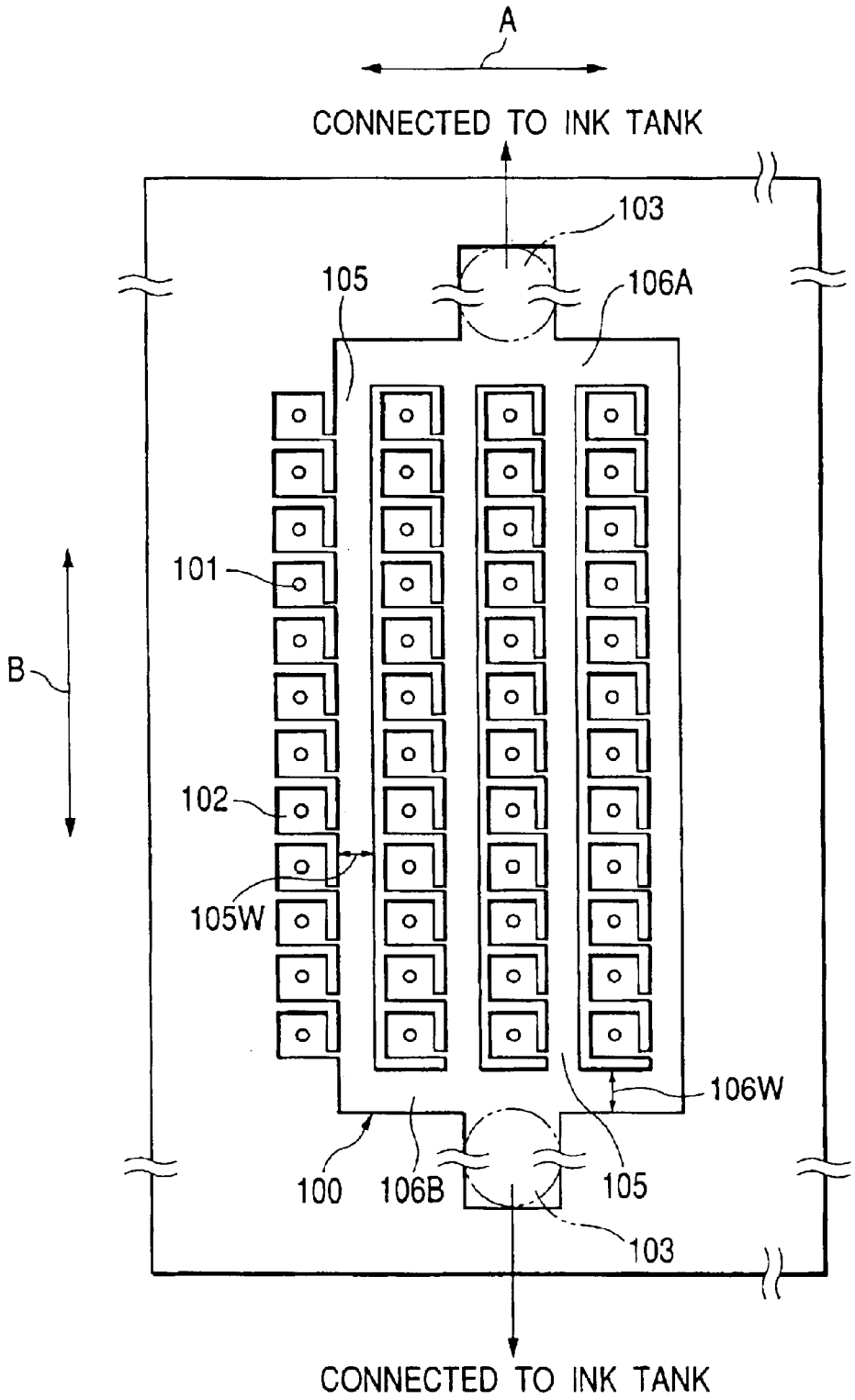
FIG. 23 is a diagram for showing a sixth structural example of a unit device which constitutes an ink jetting head according to the embodiment 1 of the present invention.

FIG. 23 schematically indicates a sixth upper surface structure of a unit device (fluid jetting device) which constitutes an ink jetting head according to the embodiment 1. In the structural example shown in this drawing, an ink supply port 103 at a center portion of a main stream 106 is also provided on the opposite side of a sub-stream 105, and both edge portions of a fluid jetting device 100 along the sub-stream 105 are connected via the separately-provided ink supply ports 103 to an ink tank. As a result, since ink is entered from the main streams 106 located at both edge portions of each of the sub-streams 105, a fluid resistance of the ink in each of the sub-streams 105 can be reduced, and width 105w of the sub-stream 105 can be made narrower.

Figure 24:
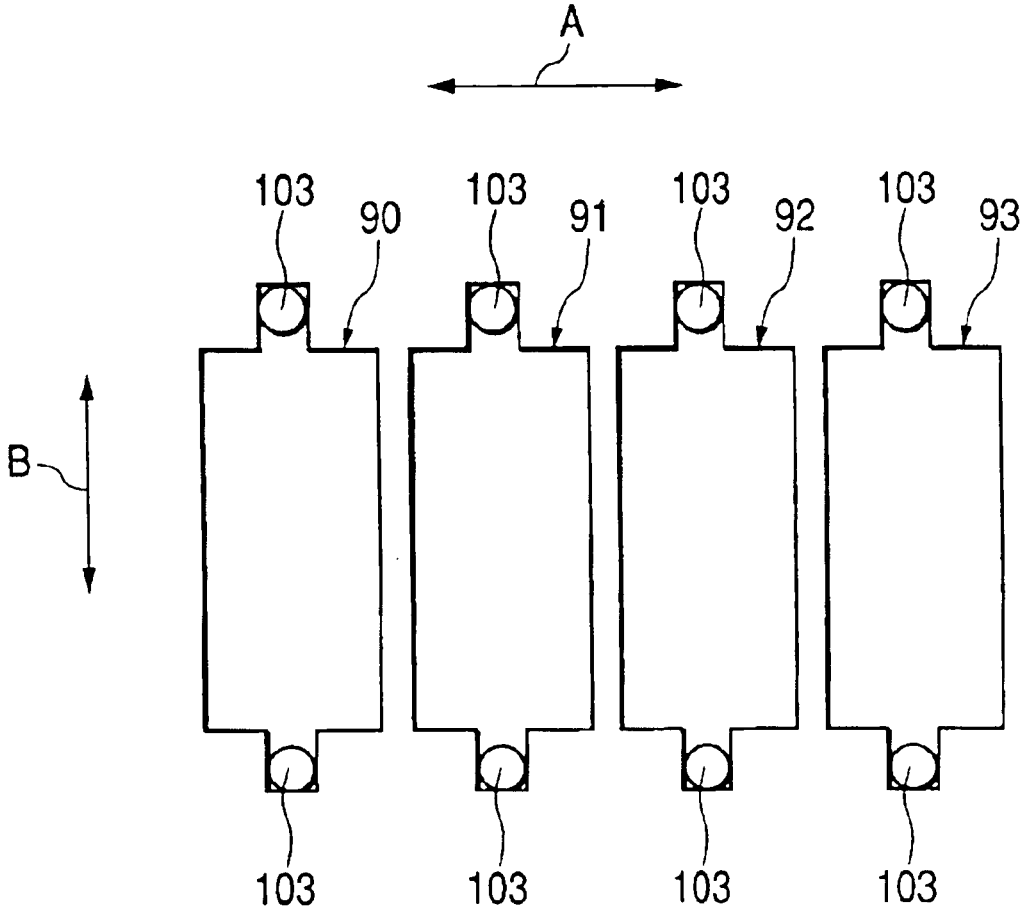
FIG. 24 is a diagram for indicating an array of fluid jetting devices shown in FIG. 23.

The fluid jetting device 100 of FIG. 23 may be arrayed as one example as shown in FIG. 24. In this case, a head width of an ink jetting head along a head scanning direction "A", on which the fluid jetting devices 90 to 93 are mounted may become narrower, as compared with the head width of the structure according to the related art, and thus, is made more compact. Also, in FIG. 23, each of the main streams 106 is provided at both edge portions of the sub-stream 105. Alternatively, while the main stream 106 is further subdivided, two, or more sets of main streams 106 may be provided on both edge portions of the sub-stream 105. It should also be noted that when the fluid jetting devices 100 shown in FIG. 22 and FIG. 23 are arrayed as a plurality of unit devices 90 to 93 shown in FIG. 24, the main streams 106 are arrayed under such a condition that these main streams 106 are positioned in parallel to the head scanning direction "A" in any one of these unit devices 90 to 93, and also, the positions of the chambers 102 are made coincident with each other along the paper transport direction "B" in each of the unit devices 90 to 93.

On the other hand, any of these ink jetting heads indicated in FIG. 22 to FIG. 24 contributes a compactness of ink jetting heads, as compared with the structure according to the related art. However, there is such a problem. That is, when a printing operation is carried out while the ink jetting head is shifted by one dot along the head scanning direction "A", adjoining dots located within the same fluid jetting device (unit device) 100 are applied to the same position to be overlapped with each other. To solve this problem, while the ink jetting head may be shifted by several dots within one time, the printing operation may be carried out. However, in this alternative case, another problem newly occurs. That is, positioning of an ink jetting head can be hardly carried out.

Seventh Structural Example

Figure 9:
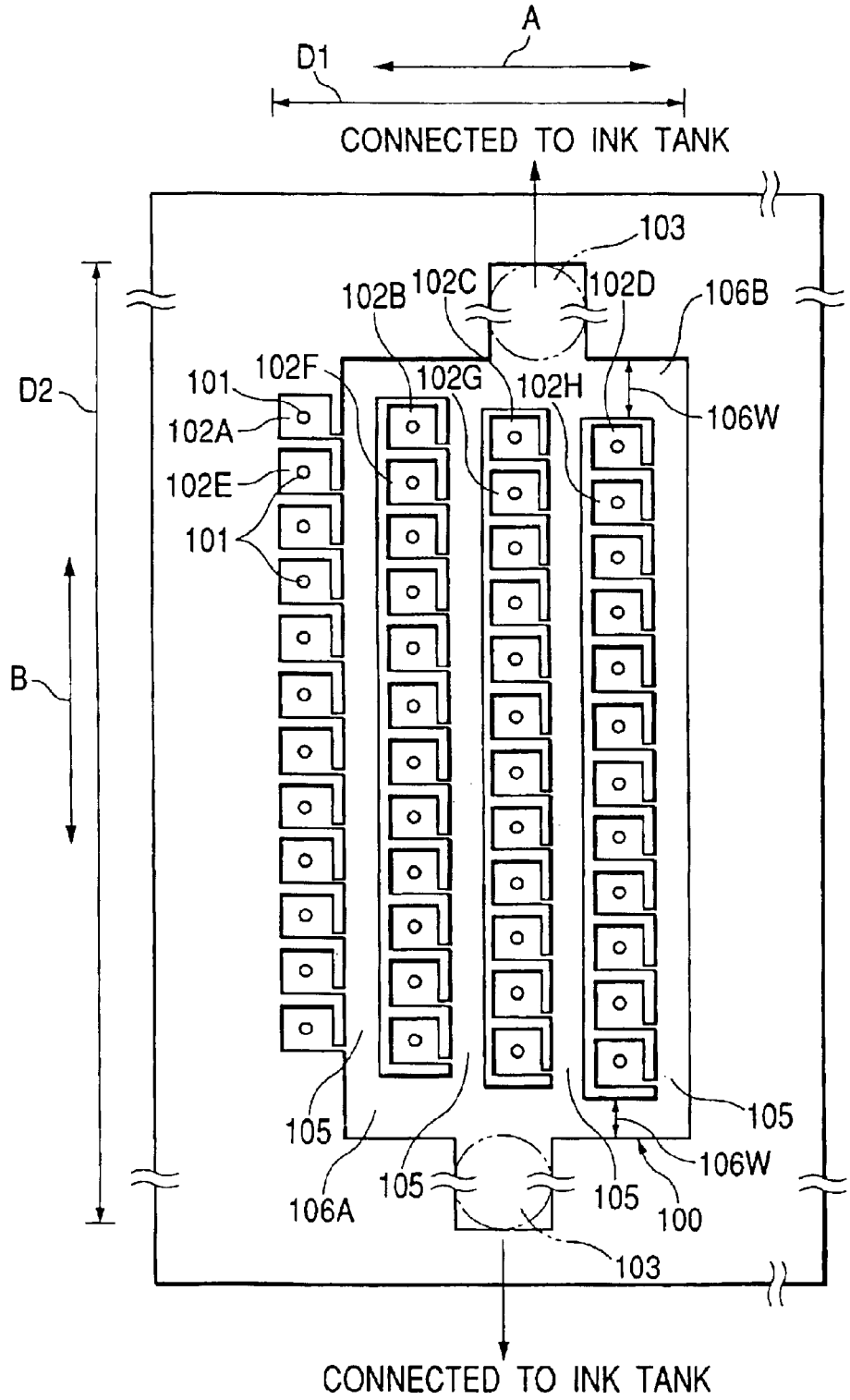
FIG. 9 is a diagram for showing a seventh structural example of a unit device which constitutes an ink jetting head according to the embodiment 1 of the present invention.

In this case, a description will now be made of a seventh structural example as to an ink jetting head capable of solving the above-described problem. FIG. 9 is a schematic diagram indicating a fluid jetting device 100 according to this embodiment.

This structure corresponds to a combination made from the third structural example shown in FIG. 5 and the fourth structural example indicated in FIG. 7. In other words, in this structural example shown in FIG. 9, as indicated in FIG. 9, the respective sub-streams 105 are connected to both an upper main stream 106A and a lower main stream 106B. These upper/lower main streams 106A and 106B are connected via ink supply ports (not shown) to an ink tank (not shown) in the vicinity of center portions of the main streams 106 in a longitudinal direction thereof.

In this structure, ink which is supplied from the above-described ink tank via the ink supply port to both the upper main stream 106A and the lower main stream 106B flows through these upper/lower main streams 106A/106B, and then, flows into the respective sub-streams. The ink which has flown into the respective sub-streams is furthermore distributed into the respective chambers 102. Operations subsequent to the above-explained operation are the same as those executed in the case of the unit device related to the first structural example as represented in FIG. 1.

It should be understood that in the structural example shown in FIG. 9, such a case is represented that total number of sub-streams is four, and total number of chambers 102 connected to a single sub-stream is twelve. However, these quantities may be properly selected.

In the seventh structural example, dot positions of chambers 102 (nozzles 101) along the paper transport direction "B", which are connected to the respective sub-streams 105, are shifted every pressure chamber column starting from chambers 102A, 102B, 102C, and 102D, respectively. In other words, the seventh structural example is arrayed in such a manner that the positions of the nozzles 101 in both the chambers 102A and 102B along the paper transport direction "B", the positions of the nozzles 101 in both the chambers 102B and 102C along the paper transport direction "B", and also the positions of the nozzles 101 in both the chambers 102C and 102D along the paper transport direction "B" are shifted by 1 dot, respectively. Also, as to rows of the respective nozzles 101 of the chambers 102A to 102D, and rows of the respective nozzles 101 of the chambers 102E to 102H, positions thereof along the paper transport direction "B" are shifted by 1 row. This structural idea is similarly applied to mutual positions of the nozzles adjacent to each other.

That is to say, in this structural example, since there is a shift of "p" dots in an elongate direction of the sub-streams 105 (symbol "p" being positive integer) between one sub-stream 105 and another sub-streams 105 adjacent to this sub-stream 105 during a printing operation, even in such a case that the printing operation is carried out while the ink jetting head is shifted by one dot in the head scanning direction, such ink droplets which are jetted from the nozzles 101 located adjacent to each other within the respective devices of the fluid jetting devices 90 to 93 (see FIG. 10) are not applied to the same position. As a result, the printing operation can be carried out by way of such a simple control operation that the ink jetting head is moved by one dot along the head scanning direction "A" in addition to realizations of the compact jetting head.

FIG. 9 indicates such a case that the shift amount between the row of the chambers 102A to 102D and the row of the chambers 102E to 102H in the paper transport direction "B" is set by one row. Alternatively, the shift amount may be set by predetermined "m" rows (symbol "m" being positive integer). In this alternative case, either one printing method or another printing method is required. That is, in one printing method, after the printing operation for the "m" rows has been carried out by feeding the ink jetting head by 1 row in the paper transport direction "B", the ink jetting head is moved over a long distance up to an unprinted portion so as to repeat the printing operation. In another printing method, after a predetermined printing area has been printed every "m" rows, a printing operation is repeatedly carried out every "m" rows in order to embed spaces between the rows, and finally, a printing portion every 1 row is formed. In this case, it is not necessary that the printing pitch is equal to an integer row, but may involve that "m" is equal to a fractional number, namely, printing rows are mutually overlapped with each other.

Figure 10:
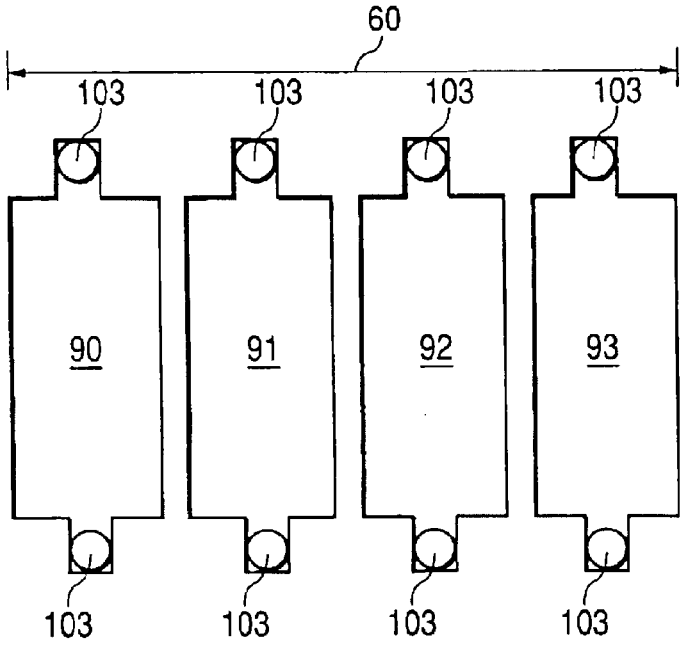
FIG. 10 is a diagram for indicating an array of fluid jetting devices shown in FIG. 9.

Also, in this structural example, the communication position (connection position) between the main stream 106 and the ink supply port 103 is set to the center position of the main stream 106 in the longitudinal direction thereof, but the present invention is not limited thereto. In the case that the widths 106*w* of the main streams 106 are different from each other depending on the positions of the main streams 106 along the longitudinal direction thereof, as explained in the upper-sided main stream 106A in FIG. 9, since the connection position is shifted to the slightly wider width 106*w*, there is such an effect that the ink is more uniformly supplied to the respective sub-streams 105. In the case that the fluid jetting devices 90 to 93 of this structural example are mounted on an ink jetting head, these fluid jetting devices 90 to 93 are typically arrayed as shown in FIG. 10. In the structural example of FIG. 10, connection positions between the main stream 106 and the ink supply port 103 in each of the fluid jetting devices 90 to 93 are provided in an eccentric manner on one side of the head scanning direction "A." In this case, the respective unit devices 90 to 93 are employed for the preselected three primary colors and the black color.

On the other hand, when the chamber 102, the sub-stream 105, and the main stream 106 are processed by way of an etching process operation for silicon, only such a pattern which is constructed of lines along <110> direction is formed. In the structure of this embodiment shown in FIG. 9, since both the head scanning direction "A" and the paper transport direction "B" are set to <110> direction respectively, such a device can be readily manufactured in a compact size.

As previously explained, since this structure shown in FIG. 9 and FIG. 10 is made by combining the third structural example with the fifth structural example, this structure has the structural merits achieved in FIG. 5 and FIG. 7. As a result, both the unit device width and the head width, and also both the unit device height and the head height can be made compact.

It should also be noted that in the structure shown in FIG. 9, each of the upper main stream 106A and the lower main stream 106B is made of a single flow path, respectively, but the present invention is not limited thereto. Alternatively, these upper/lower main streams 106A/106B may be subdivided into a plurality of flow paths.

Eight Structural Example

Figure 25:
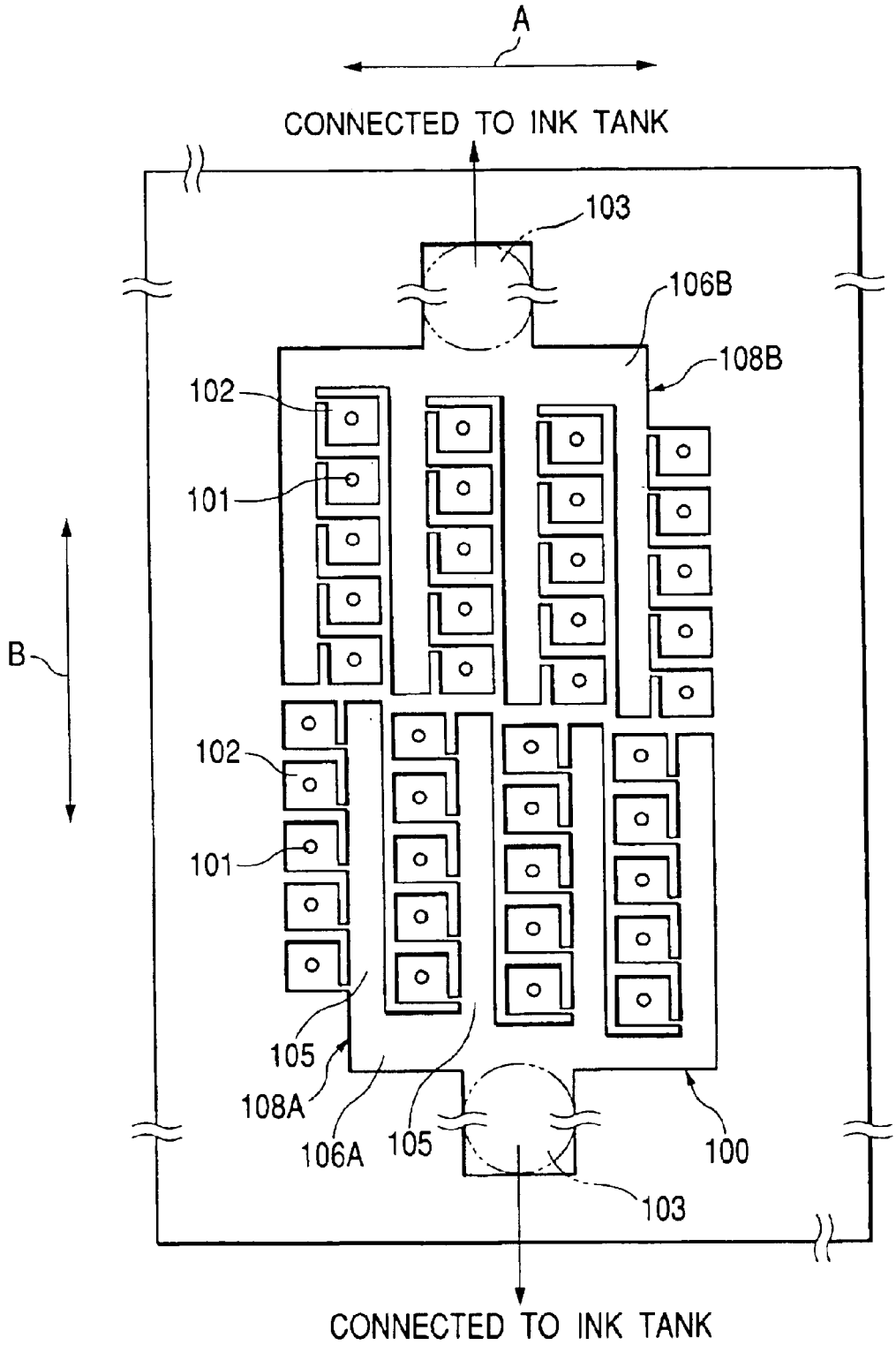
FIG. 25 is a diagram for showing an eighth structural example of a unit device which constitutes an ink jetting head according to the embodiment 1 of the present invention.

Next, an eighth structural example according to this embodiment will now be explained. FIG. 25 is a plan view for schematically indicating a fluid jetting device of this eighth structural example. In this structural example, the sub-stream 105 shown in FIG. 9 is cut out at a place near a center of this sub-stream 105, namely, two sets of sub-unit devices 108A and 108B having the same structures are combined with each other while being toward opposite directions to each other in the paper transport direction "B" so as to be constructed as a single unit device.

For instance, in the structure shown in FIG. 9, since the ink which is supplied from the main streams 106 on both sides of the respective sub-streams 105 will collide with each other in the vicinity of the center of each of the sub-streams 105, it is required to make up a design capable of suppressing adverse influences which are caused by an eddy and the like, which are produced by this collision. In contrast to this structure of FIG. 9, in accordance with this eighth embodiment, the sub-stream 105 is cut out in the vicinity of the center thereof, and thus, a collision of ink streams does not occur. Accordingly, a measure capable of avoiding the occurrence of the eddy and the like need not be taken. However, a certain space is required between the sub-unit device 108A and the sub-unit device 108B located opposite to this sub-unit device 108A. Therefore, although the width of the unit device in the head scanning direction "A" is equal to that of the structural example shown in FIG. 9, height of the unit device in the paper transport direction "B" becomes slightly higher than that of FIG. 9.

Ninth Structural Example

Figure 26:
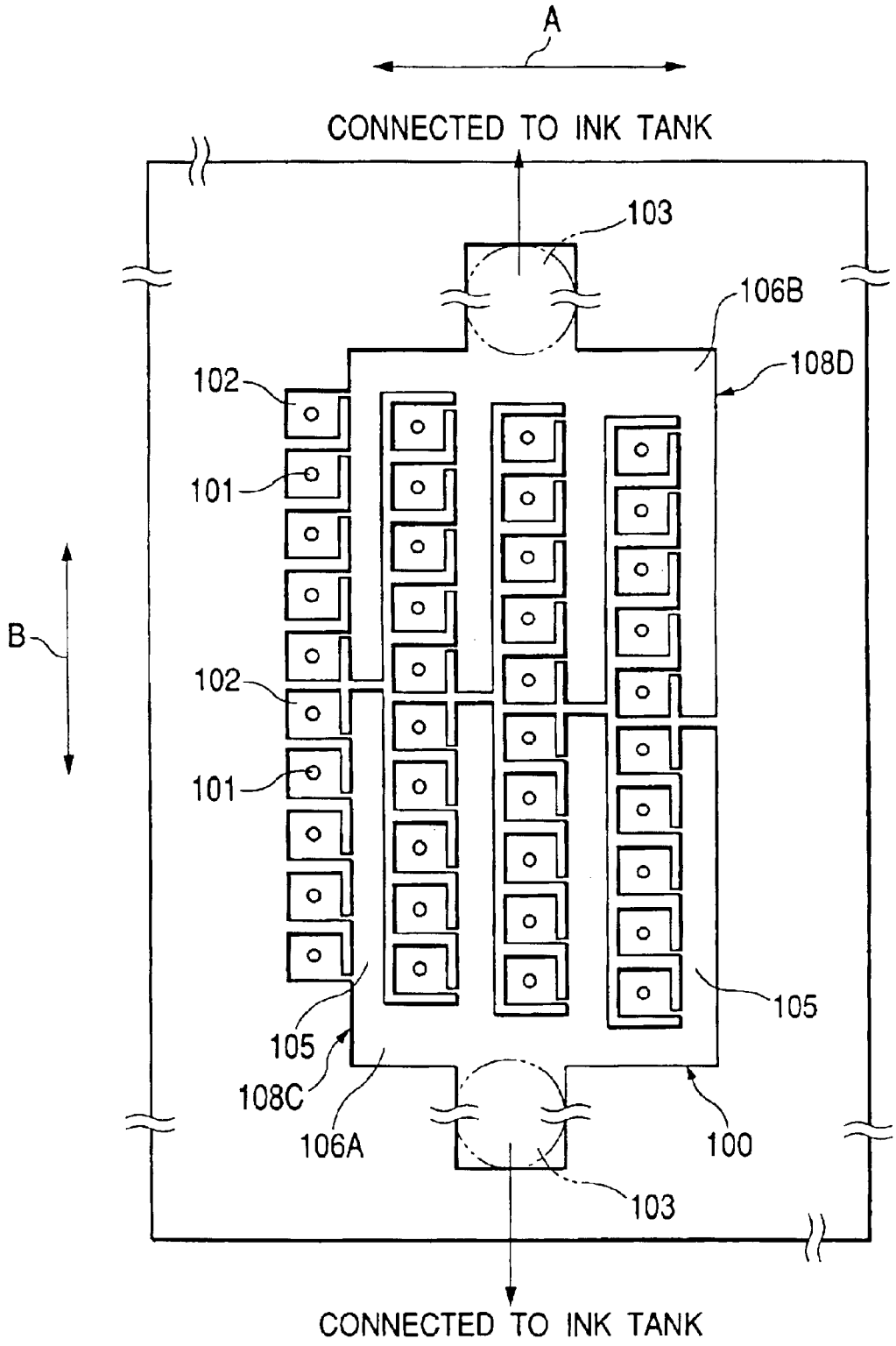
FIG. 26 is a diagram for showing a ninth structural example of a unit device which constitutes an ink jetting head according to the embodiment 1 of the present invention.

Next, a ninth structural example according to this embodiment will now be explained. FIG. 26 is a plan view for schematically indicating a fluid jetting device of this ninth structural example. In this structural example, in comparison with the structure of FIG. 25, while sub-unit devices 108C and 108D having different structures are combined with each other, namely while these sub-unit devices 108C and 108D have shapes which become substantially linear symmetric with each other with respect to a center position along the paper transport direction "B", a single fluid jetting device (unit device) 100 is constituted. In accordance with this embodiment, since no longer any space is required between the sub-unit device 108C and the sub-unit device 108D, heights of the unit devices in the paper transport direction "B" can be suppressed. It should be understood that since the structure of the sub-unit device 108C is different from the structure of the sub-unit device 108D, it is necessary that the supplies of ink to the chambers 102 via the sub-streams 105 is made uniform with each other. In the case that the fluid jetting devices 100 having the structures shown in FIG. 25 and FIG. 26 are mounted on an ink jetting head, these fluid jetting devices 100 are typically arrayed in such an arrangement shown in FIG. 10.

In the above-described unit devices shown in the structural examples 1 to 9, such a case is indicated in which a supply path from an external ink tank to a single main stream is only one supply path. Alternatively, instead of this single supply path, a plurality of supply paths may be employed. Also, in these drawings, such a case is exemplified. That is, a supply path from a main stream to a sub-stream is either one place or two places. Alternatively, three, or more supply paths may be employed.

Figure 11A:
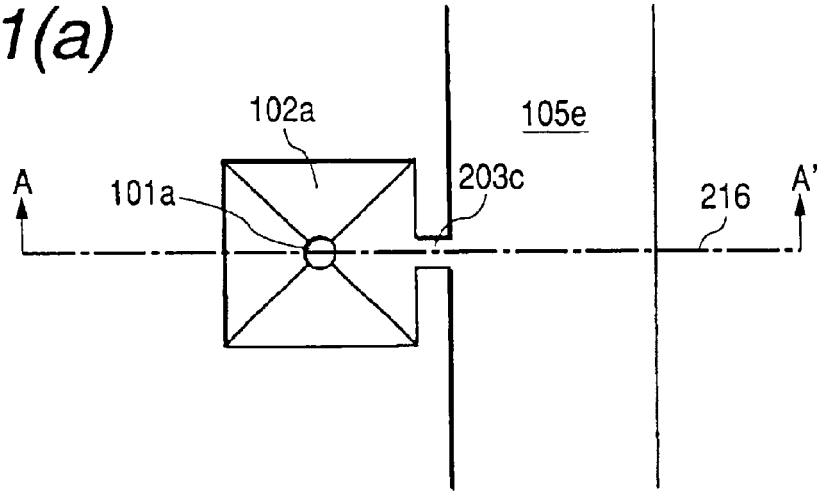
FIG. 11 is a diagram for indicating a positional relationship between chambers and sub-streams in the fluid jetting device according to the embodiment 1.
Figure 11B:
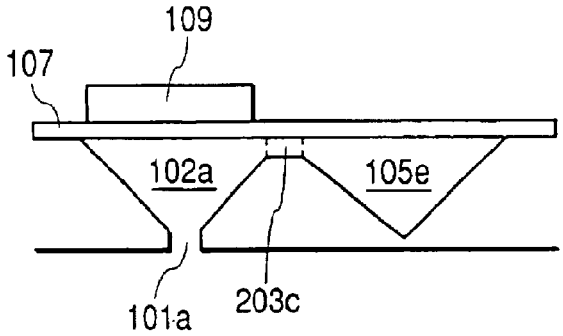

FIG. 11 indicates a typical structure as to both a chamber and a sub-stream, which may be applied to the fluid jetting device according to the embodiment 1 of the present invention. FIG. 11(*a*) is an upper view for indicating this typical structure, and FIG. 11(*b*) is a sectional view for showing the typical structure of FIG. 11(*a*) when being cut away along an arrow A-A' (dotted line 216).

In the fluid jetting device, as indicated in FIG. 11, the sub-stream 105*e* is connected via a notch (namely, ink supply path) 203*c* to the chamber 102*a*. A nozzle 101*a* is formed in a center portion of the chamber 102*a*. Also, an actuator 109 is set via a pressure applying plate 107 on an upper surface of the chamber 102*a* on the opposite side of the nozzle 101*a*. It should also be noted that a heating element may be provided instead of the pressure applying plate and the actuator.

Figure 12:
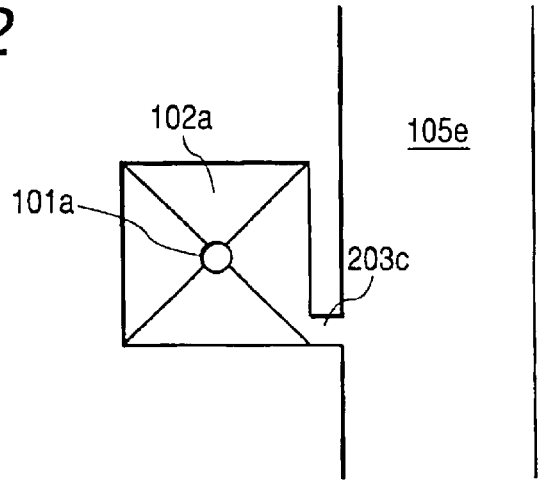
FIG. 12 is a diagram for indicating a modified example of the structure shown in FIG. 11.

FIG. 12 is a modification of the structure shown in FIG. 11(*a*), and represents such an example that the notch (ink supply path) 203*c* is provided on an edge portion of the chamber 102*a*. It should also be noted that this notch (ink supply path) 203*c* may be provided at an arbitrary position other than the example shown in FIG. 12.

Figure 13A:
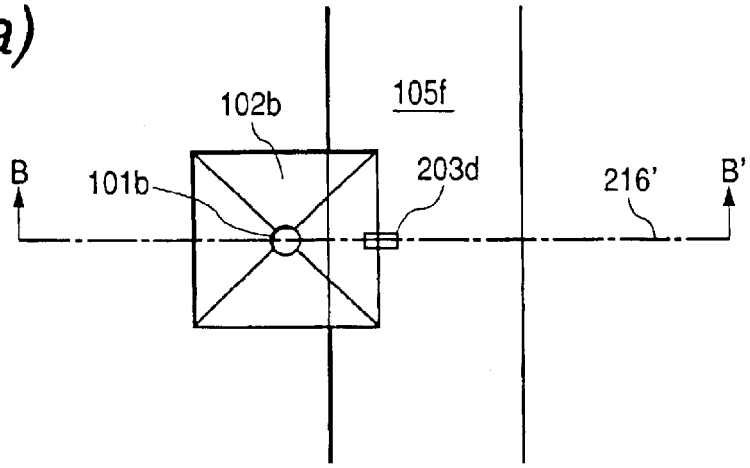
FIG. 13 is a diagram for indicating another example as to structures of chambers and sub-streams, which can be applied to the fluid jetting device according to the embodiment 1.
Figure 13B:
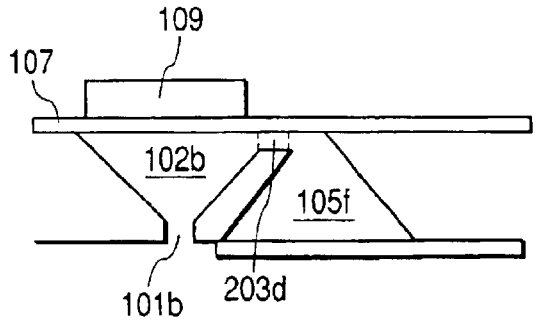

FIG. 13 indicates another example as to structures of a chamber and a sub-stream, which may be applied to the fluid jetting device according to this embodiment 1. FIG. 13(*a*) is an upper view of this structure, and FIG. 13(*b*) is a sectional view for indicating a device structure of FIG. 13(*a*) when being cut away along an arrow B-B' indicated by a dotted line 216'.

As shown in FIG. 13, a sub-stream 105*f* is connected via a notch (ink supply path) 203*d* to a chamber 102*d*. A featured structure is realized by that a portion of the sub-stream 105*f* is overlapped with a portion of the chamber 102*b* in a three dimensional manner. Also, an actuator 109 is set via a pressure applying plate 107 on an upper surface of the chamber 102*b* on the opposite side of a nozzle 101*b*. It should also be noted that a heating element may be provided instead of the pressure applying plate and the actuator.

Figure 14:
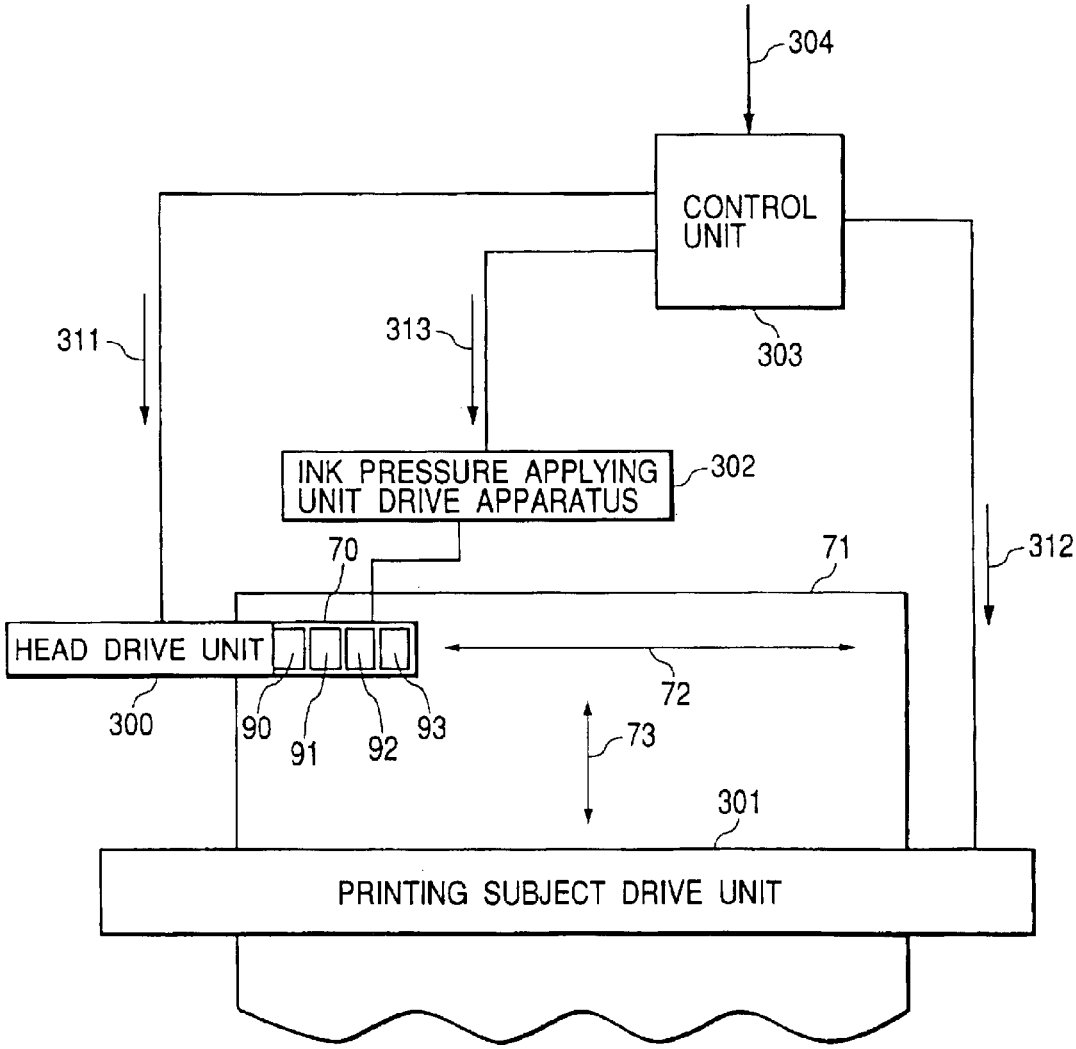
FIG. 14 is a diagram for indicating a schematic arrangement of a printing apparatus to which the fluid jetting device according to the embodiment 1 is applied.
Figure 15A:
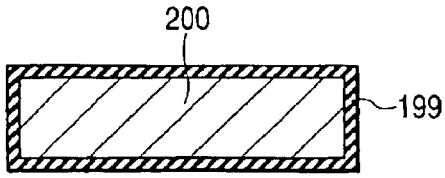
FIG. 15 is a diagram for indicating a manufacturing step for the fluid jetting device according to the embodiment 1.
Figure 15B:
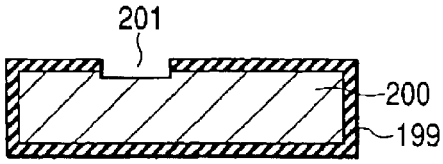
Figure 15C:
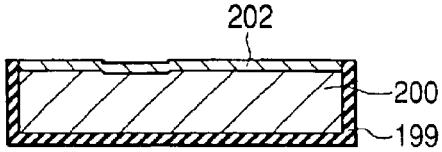
Figure 15D:
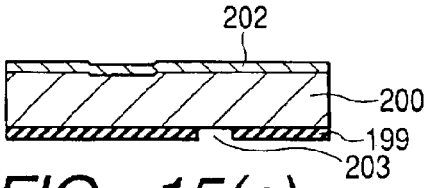
Figure 15E:
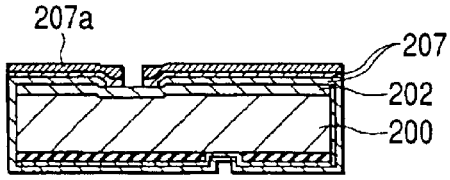
Figure 15F:
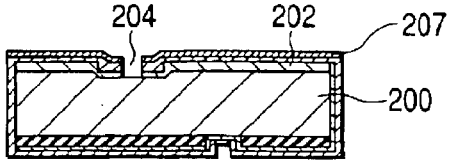
Figure 15G:
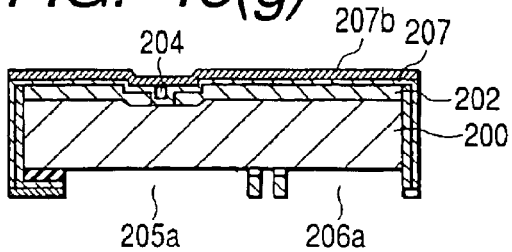
Figure 15H:
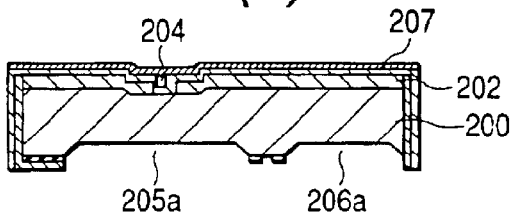
Figure 15I:
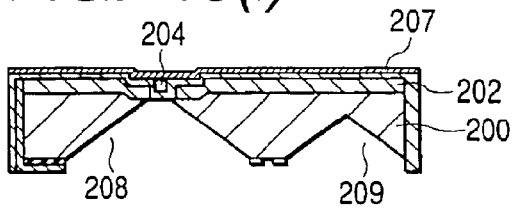
Figure 15J:
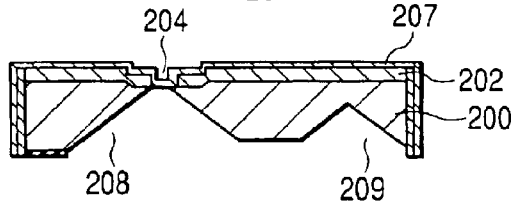
Figure 15K:
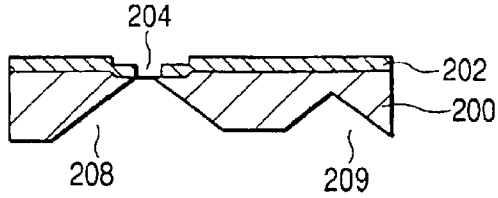

FIG. 14 shows a schematic arrangement of a printing apparatus to which the fluid jetting device according to the embodiment 1 of the present invention is applied. As indicated in this drawing, the above-described unit device 90, 91, 92, and 93 are arrayed along the lateral direction in a printer head 70. Furthermore, a head drive unit 300 is connected to the printer head 70. Thus, the printer head 70 may be moved along a moving direction (main scanning direction) by this head drive unit 300. With respect to this printer head 70, a printing subject 71 may be moved along a printing subject moving direction 73, while this printing subject 71 is made in contact with a printing subject drive unit 301.

While the head drive unit 300 is connected to a control unit 303, this head drive unit 300 drives the printer head 70 to be reached at a predetermined position at a preselected time instant (preselected timing) based upon a head drive unit control signal 311 sent from the control unit 303. In this case, the expression "being connected" implies that a signal can be supplied. A sort of this signal involves an electric signal, an optical signal, and a wireless (radio) signal.

While the printing subject drive unit 301 is also connected to the control unit 303, this printing subject drive unit 301 drives the printing subject 71 to be located at a predetermined position at a preselected time instant (timing) in response to a printing subject drive unit control signal 312 sent from the control unit 303. In this case, the expression "being connected" owns the same implication as the above expression.

Each of pressure applying units (not shown in detail) employed in the respective unit devices 90, 91, 92, 93, which are stored in the printer head 70, is connected to an ink pressure applying unit drive apparatus 302. The pressure applying units apply pressure to ink stored in the respective chambers by receiving drive force supplied from this drive apparatus 302. As a result, the ink may be jetted from nozzles provided in the chambers. It should be understood in this case that the expression "being connected" implies that the drive force can be supplied. A sort of this drive force may be conceived as electric drive force such as a voltage and a current, and also as optical drive force.

The drive unit 303 supplies a drive apparatus control signal 313 with respect to the ink pressure applying unit drive apparatus 302 connected thereto. This drive apparatus control signal contains such information that the ink pressure applying unit drive apparatus 302 is driven at what time, at which unit device, in which pressure applying unit, by how degree of drive force, and how long. In this case, the expression "being connected" implies that a signal can be supplied. A sort of this signal involves an electric signal, an optical signal, and a wireless (radio) signal.

An external signal 304 is sent from an external unit to the control unit 303. This control unit 303 coverts this external signal into the head drive unit control signal 311, the printing subject drive unit control signal 312, and the drive apparatus control signal 31. Then, these signals are sent to the head drive unit 300, the driving subject drive unit 301, and the ink pressure applying unit drive apparatus 302, respectively.

Forming Method of Head

Next, a description will now be made of a method for forming a fluid (liquid) jetting device of an ink jetting head according to this embodiment 1. FIG. 15(*a*) to FIG. 15(*k*) show a manufacturing process of a head, which may be applied to a silicon head. It should be noted that this drawing is a sectional view for showing both a chamber portion and a sub-stream portion.

When the fluid jetting device (liquid jetting device) is manufactured, while a silicon substrate 200 is firstly prepared, an oxide film 199 is formed on a peripheral portion of this silicon substrate 200, as shown in FIG. 15(*a*). Next, as represented in FIG. 15(*b*), a counterbore 201 (concave portion ) is formed in this silicon substrate 200. In this case, such a manner is employed. That is, while a position on the silicon substrate 200 other than the counterbore forming portion is covered by photoresist, the counterbore 201 is formed by way of a milling, and the photoresist is removed.

Next, as shown in FIG. 15(*c*), a boron diffusion layer 202 is formed by way of ion implantation and the like. Then, as indicated in FIG. 15(*d*), a notch (ink supply path) 203 is formed in a rear side of the substrate 200 (namely, lower side of substrate as view in this drawing). Also, in this case, such a manner is employed. That is, while a portion of the rear surface of the silicon substrate 200 other than the notch (ink supply path) forming portion is covered with photoresist, the notch (ink supply path) 203 is formed, and the photoresist is removed.

In a manufacturing step shown in FIG. 15(*e*), a stacked layer protection film 207 capable of reinforcing a nozzle portion is formed, and while a position other than a nozzle forming portion is covered by photoresist 207*a*, the nozzle forming portion of the stacked layer protection film 207 is removed by a milling. Then, the photoresist 207*a* is removed, and as shown in FIG. 15(*f*), a nozzle 204 is formed by way of a milling, and the like.

In a manufacturing step of FIG. 15(*g*), both a chamber forming portion 205*a* and a sub-stream forming portion 206*a* are formed on the rear surface of the substrate. In this case, such a manner is employed. That is, while a position of the rear surface of the silicon substrate 200 other than both the chamber forming portion 205*a* and the sub-stream forming portion 206*a* is covered by photoresist 207*b*, a notch (ink supply path) is formed by way of a milling, and the photoresist 207*b* is removed.

In manufacturing steps indicated in FIG. 15(*h*) and FIG. 15(*i*), an etching process is carried out with respect to the silicon substrate 200. That is, FIG. 15(*h*) indicates a shape of the silicon substrate 200 while the etching process is performed. FIG. 15(*i*) shows a shape of the silicon substrate 200 when the etching process is completed.

Next, in a manufacturing step indicated in FIG. 15(*j*), an etching process is carried out as to the silicon substrate 200. This drawing shows a shape of the silicon substrate 200 when the etching process is accomplished. Then, as shown in FIG. 15(*k*), both the stacked layer protection film 207 and the oxide film 199 are removed by performing an etching process. It should also be noted that although not shown in the drawing, in a final step, both a pressure applying plate and an actuator may be provided on the rear side of the chamber, or a heating element is joined to the rear side of the chamber in order to jet ink.

Figure 16:
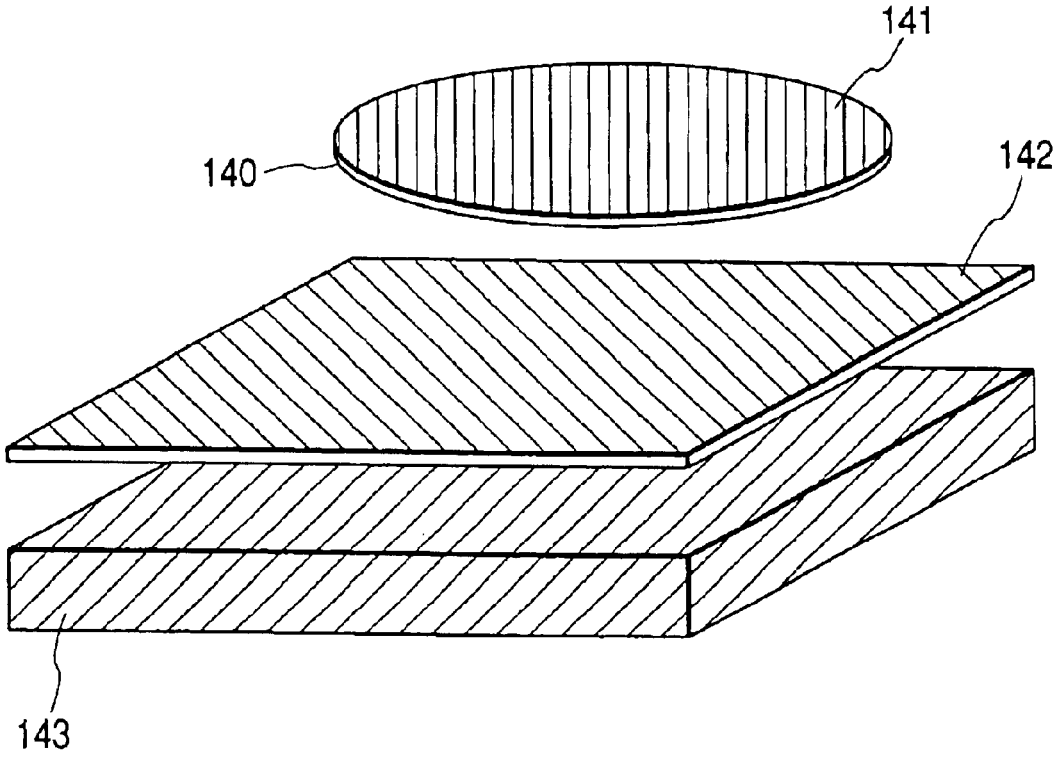
FIG. 16 is a diagram for representing a head forming method executed by laminating metals.
Figure 17:
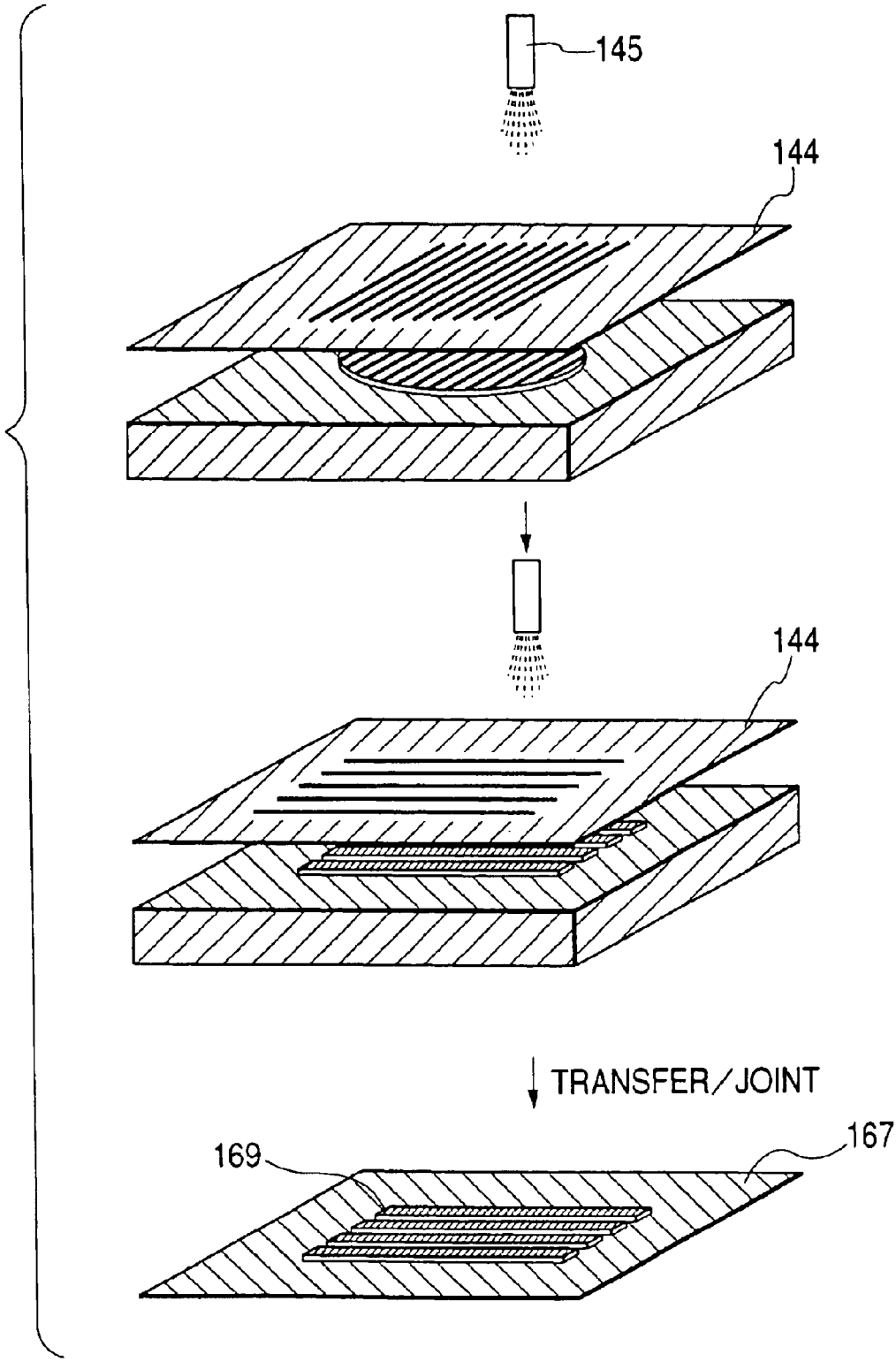
FIG. 17 is a diagram for representing a head forming method (sand blast process) executed by laminating metals.
Figure 18:
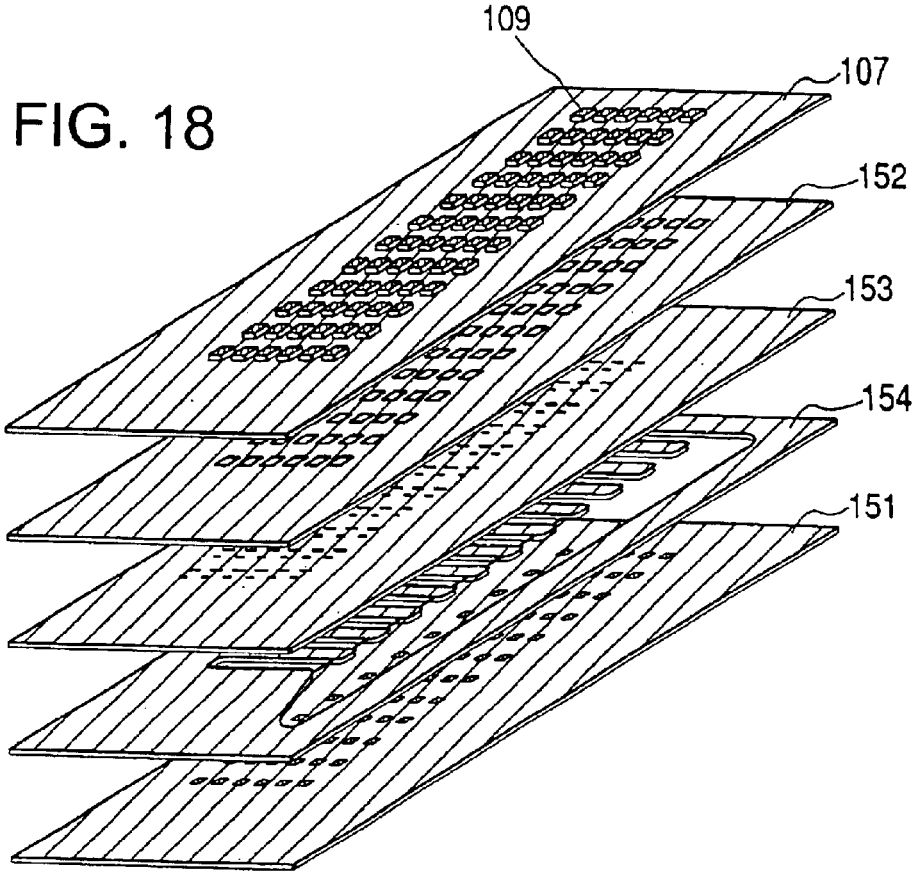
FIG. 18 is a diagram for representing a head forming method (member for constructing ink chamber) executed by laminating metals.
Figure 19:
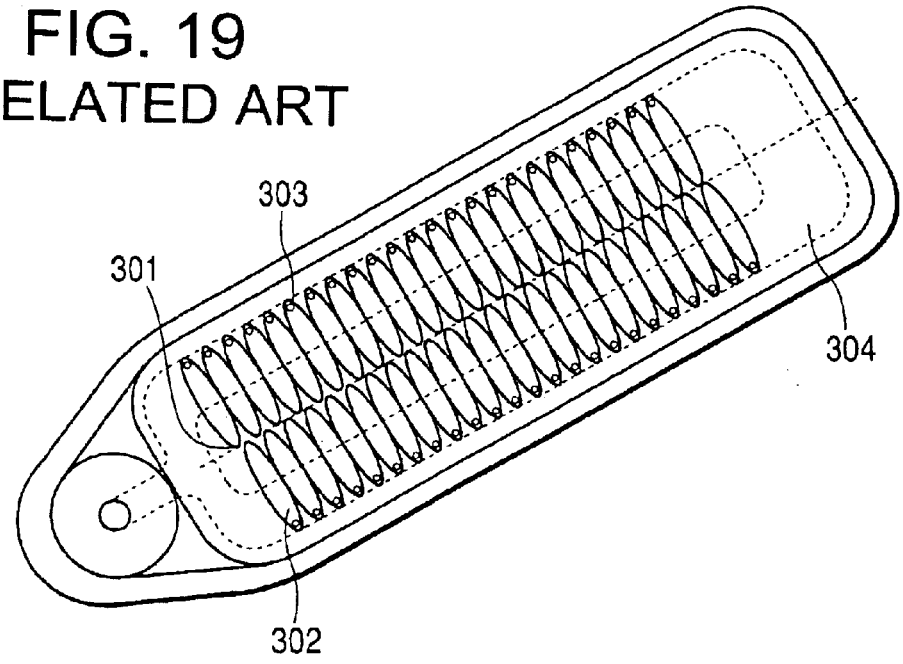
FIG. 19 RELATED ART
FIG. 19 is a diagram for indicating the structure of the fluid jetting device according to the related art.

A laminating method of metal plates as the head forming method will now be explained with reference to FIG. 16 to FIG. 18. In a manufacturing step shown in FIG. 16, a sheet-shaped piezoelectric member 140 in which gold (Au) electrodes 141 are vapor-deposited on both surfaces thereof is adhered via a provisionally-fixed adhesive sheet 142 onto a provisionally-fixed substrate 143. Thereafter, as shown in FIG. 17, while a mask 144 is employed which has been manufactured in coincidence with both a position and a dimension required as an actuator, a sand blast treatment is carried out by using a sand blast nozzle 145 so as to separate the respective actuators 169.

Furthermore, an electric-conductive adhesive agent (not shown) is coated on the surface of this actuator 169, and the actuator 169 is transferred to the pressure applying plate 167 so as to be joined. Thereafter, both the provisionally-fixed adhesive sheet 142 and the provisionally-fixed substrate 143 are removed. Since the above-described manufacturing steps are carried out, a unit made of both the pressure applying plate 167 and the actuator 169 may be accomplished.

Next, a description will now be made of a step for manufacturing an ink chamber which contains a nozzle 101, a chamber 102, a comb-shaped ink pool sub-stream 5, and the like. FIG. 18 represents members which constitute the ink chamber. In other words, this drawing shows a nozzle plate 151 having the nozzle 101, the comb-shaped ink pool sub-stream 105, a pool plate 154 having a main stream 106, a supply hole plate 153 having a supply hole, a chamber plate 152 having a chamber, and also, a pressure applying plate 107. It should be noted that a rolled member such as SUS may be employed as the all of these members.

Both the nozzle 101 and the supply hole 103 are formed by employing a punching press treatment, whereas both the comb-shaped ink pool sub-stream 105 and the chamber 102 are formed by employing an etching process operation. The respective plates 151, 152, 153, and 154 except for the pressure applying plate 107, which constitute the ink chamber members, are adhered/joined to each other. Thereafter, the pressure applying plate 107 to which the above-described actuator 109 has been adhered is adhered/joined to these plates.

Furthermore, electric connections are made with respect to individual electrodes (not shown) arranged in the respective actuators 109 so as to apply drive voltages thereto. In this embodiment, while an electrode terminal of an FPC cable (not shown) is arranged at an outer peripheral portion of a matrix arrangement, this electrode terminal is connected to the individual electrodes of the respective actuators 109 by way of wire bonding. Thereafter, since the piezoelectric characteristic is applied to the actuator 109, a bias voltage is applied to this actuator 109 so as to execute a polarization process operation.

As previously explained, in accordance with this embodiment, the unit device of the ink jetting head employs the following structures. That is, the main streams of the fluid pool at the two upper/lower portions thereof are connected via the ink supply port to the ink tank, the ink supply port is provided in the vicinity of the center of the main stream, or the ink tanks are connected to both the upper main stream and the lower main stream. As a consequence, the substantial flow path in the main stream can be shortened, and both the compact fluid jetting head and the more compact fluid jetting apparatus containing this fluid jetting head can be realized.

Also, since the fluid jetting head can be made compact, the head weight can be reduced and therefore, force of inertia produced when the head is driven can be decreased, so that vibrations and noise caused by the fluid jetting apparatus can be lowered. Then, as a result of improving of the head positioning precision, the jetting/applying position can be correctly controlled. In particular, since the fluid jetting head can be made compact along the main scanning direction thereof, the lateral width of the fluid jetting apparatus can be made small, and the fluid jetting apparatus itself can be made compact.

Furthermore, in the case that the fluid jetting head is manufactured by way of the silicon process, large numbers of these heads can be manufactured from a single sheet of wafer. Alternatively, in the case that the fluid jetting head is manufactured by the laminating process, large numbers of these heads can be manufactured from a single substrate. As a result, the manufacturing cost of the fluid jetting head can be reduced.

Also, the external signal is converted into the control signal of the head drive unit, the control signal of the printing subject drive unit, and the control signal of the drive apparatus. The converted control signals are supplied to the head drive unit, the printing subject drive unit, and the ink pressure applying unit drive apparatus, respectively, in the printing apparatus which uses the fluid jetting device according to this embodiment. Since the position of the head, the position of the printing subject, and the application of the ink pressure are synthesized with each other in the temporal manner, the color tone having the predetermined color and the light/dark portions can be represented at an arbitrary position within the printing range of the printing subject.

Embodiment 2: In Case that Fluid to be Jetted is Fluid Containing Organic EL Material Subsequently, an embodiment 2 of the present invention will now be explained. In accordance with this embodiment 2, while a fluid jetting device, a fluid jetting head, and a fluid jetting apparatus, use a fluid containing an organic material for an organic EL (electroluminescence) as a fluid to be jetted, since a substrate for an organic EL display is employed as a subject to be applied, an element for manufacturing the organic EL display, a head, and an apparatus are manufactured.

In this case, as a lower electrode, inorganic electrode patterns for organic EL such as ITO have been previously formed on a transparent substrate. Alternatively, such an organic material as PEDT polyaniline is employed as the electrode. Then, a fluid for soluting these materials is jetted onto the transparent substrate so as to form a pattern in an apparatus to which the above-described fluid jetting device according to the embodiment 1 has been applied.

As materials which can be jetted/applied so as to form patterns by this fluid jetting device, a material used for an electron injecting layer, a material used for an electron transporting layer, a material used for a light emitting layer, a material used for a hole transporting layer, a material used for a hole injecting layer, and also, a material used for an upper electrode layer may be conceived. It should be understood that such a better case may be realized as to the upper electrode. That is, ITO and metal materials are processed in separate steps so as to form a film and a pattern.

Also, in order to manufacture an organic display capable of realizing a color representation, the above-described preselected materials for the three primary colors are required to be jetted/applied.

Preferably, wiring lines which are employed so as to connect the respective electrodes to a current supplying apparatus have been previously manufactured on the substrate. Also, in order to manufacture an active matrix type display, it is preferable to previously form wiring lines on the substrate, while these wiring lines are employed so as to connect transistors for switching elements to electrodes of transistors and organic EL elements, and also, a current supply apparatus.

As the respective members which constitute the organic EL element, organic EL elements as listed in the below-mentioned tables 1 and 2 may be typically employed:

TABLE 1

| | |
|---|---|
| anode | ITO (indium-tin-oxide), mixture of In oxide and Zn oxide, polyaniline, PEDT, Au |
| cathode | MgAg, Ca, Al, LiAl |
| cathode buffer layer | Li, Ca, Mg, Sr, Ba, LiF, MgO, MgF2, CaF2, SrF2, BaF2 |
| electron injection/transfer layer | low-polymer-system materials: Alq3, PBD, TAZ, BND, OXD, OXD-7; high-polymer-system materials: PPV |
| light emitting layer | low-polymer-system materials: host dye such as Alq3, Znq2, Zn(BOX)2, Zn(BTZ)2, BeBq2, Be(5Fla)2, BAlq2, Aloq3, Alph3, Zn(ODZ)2, Zn(TDZ)2, Zn(PhPy)2, Zn(BlZ)2, Alpq3, Al(ODZ)3, Zn(NOD)2, Zn(Phq)2, Zn(NOOD)2 or materials in which the below-mentioned guest dye has been added to the above materials; Perylene, Qd-1, Coumarine6, Qd-3, Qd-2, DCK1, BCzYBi, Bubrene, TPP, DCM2, Coumarin540, Rhodamine6G, Qninacridone, Sq, Pyazoline, Decacyclane, Phenoxasonze, Eu high polymer-system materials: materials contain both precursor of conjugated system high polymer organic compound and at least one sort of fluorescent substance as light emitting materials of high polymer system. As the precursor, polyparaphenylenevinylene derivative such as PPV(polyparaphenylenevinylen), Ro-PPV, CN-PPV, MEH-PPV, DMOS-PPV; polythiophene derivative such as PAT, PCHMT, POPT, PTOPT, PDCHT, PCHT, POPT; polyparaphenylene derivative such as PPP (polyparaphenylene), |

TABLE 1-continued

| | |
|---|---|
| | RO-PPP, FP-PPP, PDAF; polysilane derivative such as PMPS, PPS, PMrPrS, PNPS, PBPS; polyacetylene derivative such as PAPA, PDPA; and other derivative such as PdPhQx, PQx, PVK, PPD; or materials in which the below-mentioned dye has been added to the above materials; Perylene, Qd-1, Coumarine6, Qd-3, Qd-2, DCM1, BCzVBi, Pubrene, TPP, DCM2, Coumarin540, Rhodamine6G, Quinacridone, Sq, Pyazoline, Decacyclene, Phenoxazone, Eu. |

TABLE 2

| | |
|---|---|
| hole injection/transfer layer | low-polymer-system materials: triphenylamine derivative, Copper phthalocyanine compound, α-NPD |
| anode buffer layer | low-polymer-system: CuPc, n-MTDATA, VaO, MoO high-polymer-system materials: polyaniline, polythiophene |
| protection layer | Al oxide, Al nitride, Si oxide, Si nitride, or mixture of these materials |
| switching element | transistor |
| current applying element | transistor |
| switching wiring, line, current applying wiring line, second switching wiring line, common wiring line, ground wiring line | Al, Cu, Ta, Ru, WSi |

Also, as the respective elements which constitute the switching transistor and the current applying transistor, elements as listed in the below-mentioned table 3 may be employed:

TABLE 3

| | |
|---|---|
| source/drain electrodes, gate electrode | Al, Cu, Ta, Ru, WSi |
| gate insulating film, first interlayer insulating film; second interlayer insulating film; barrier layer | Al oxide, Al nitride, Si oxide, Si nitride, or mixture of these materials |

Embodiment 3: In Case that Fluid to be Jetted is Fluid Containing Organic Semiconductor Material Subsequently, an embodiment 3 of the present invention will now be explained. In accordance with this embodiment 3, while a fluid jetting device, a fluid jetting head, and a fluid jetting apparatus, use a fluid containing an organic material for an organic semiconductor element as a fluid to be jetted, since a substrate for an organic semiconductor element is employed as a subject to be applied, an element for manufacturing the organic semiconductor element, a head, and an apparatus are manufactured.

In the above-described case, while both a source electrode and a drain electrode have been previously formed on a substrate, a fluid containing an organic semiconductor is jetted by a fluid jetting apparatus to which the above-described fluid jetting device according to the above-described embodiment 1 is applied in such a manner that this fluid may bridge both the source electrode and the drain electrode. Then, after these elements have been fixed, a gate electrode pattern is formed between the source electrode and the drain electrode.

Alternatively, an insulating layer is formed on an organic semiconductor layer, on which a gate electrode is formed. Otherwise, while a gate electrode is formed on a substrate, on which an insulating layer is formed, both a source electrode pattern and a drain electrode pattern are formed on the resulting substrate, on which an organic semiconductor layer is formed by employing a fluid jetting head.

Alternatively, while organic materials are employed as the respective electrodes and the insulating layers, a solution fluid containing these organic materials may be jetted/applied by a fluid jetting head made of the fluid jetting device according to the embodiment 1 so as to form patterns.

As the organic semiconductor material to this end, pentacene, regioregular poly (lliophene), and the like may be used. Also, as the organic electrode material, highly-doped polyaniline and PEDOT may be employed. If insulating materials own process adaptive characteristics, then various sorts of such insulating materials may be applied.

Embodiment 1

Figure 27:
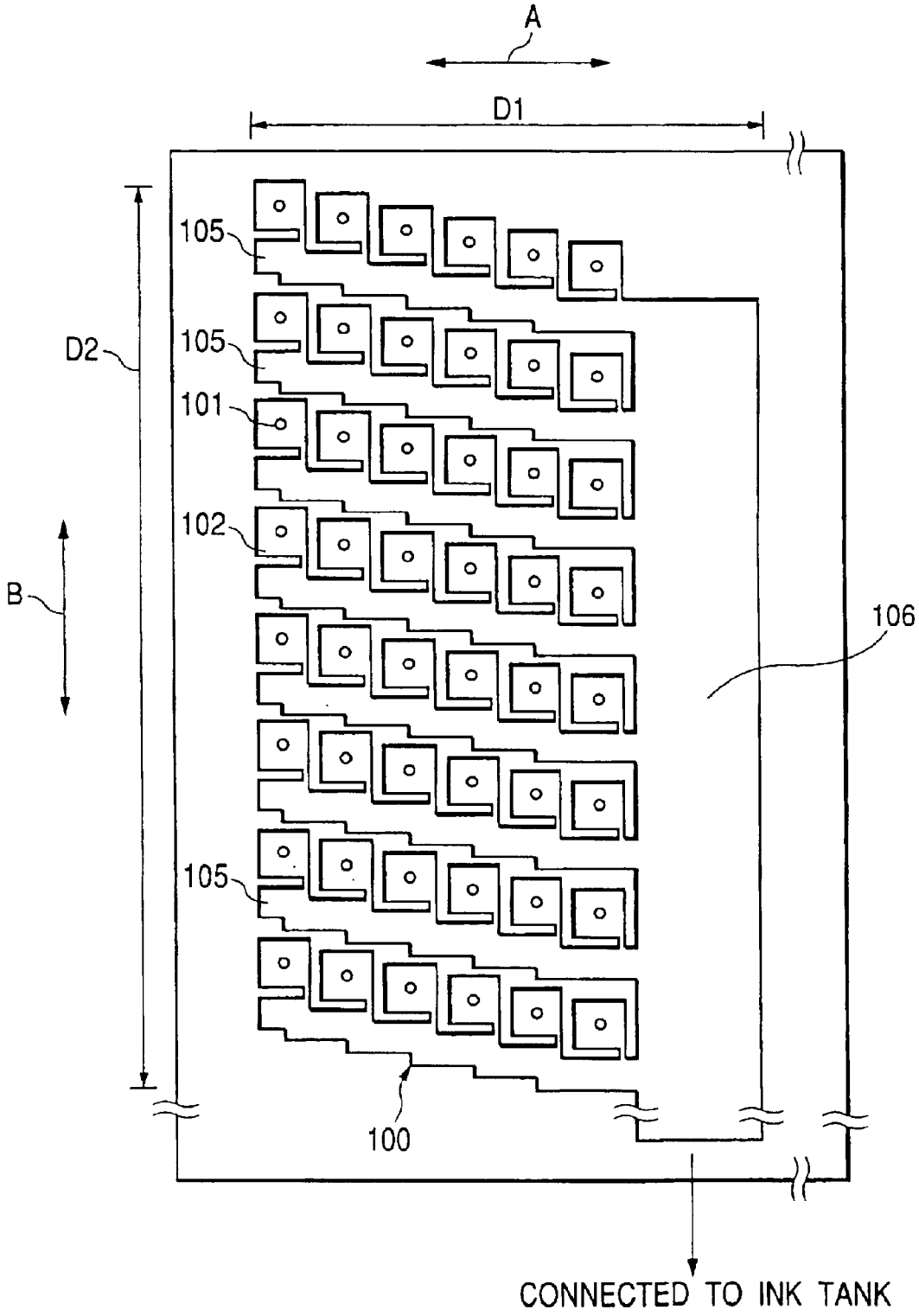
FIG. 27 is a diagram for indicating the structure of the fluid jetting device according to the related art.

In this embodiment, while a total number of the pressure chambers arrayed along the head scanning direction "A" is changed and also a total number of the pressure chambers arrayed along the paper transport direction "B" is changed, both widths of main streams and widths of branching streams were calculated which were required to calculate fluid resistances in the structural example of the present invention shown in FIG. 9 and the structural example of the prior art indicated in FIG. 27. Based upon these values, both a minimum unit device width "D1" and a minimum unit device height "D2" were calculated. This calculation result is indicated in a table 4. In this case, it was so assumed that the depth of the branching flow path and the depth of the main flow path were constant, respectively. The shape of the pressure chamber was a regular square, as viewed in a plan view, which have a superior jetting capability, and may be easily manufactured. Alternatively, even when this pressure chamber may have a regular P-angular shape (symbol "P" being integer larger than 5, or more), or a circular shape, the substantially same effect as obtained in the present calculation may be achieved.

TABLE 4

Figure 21:
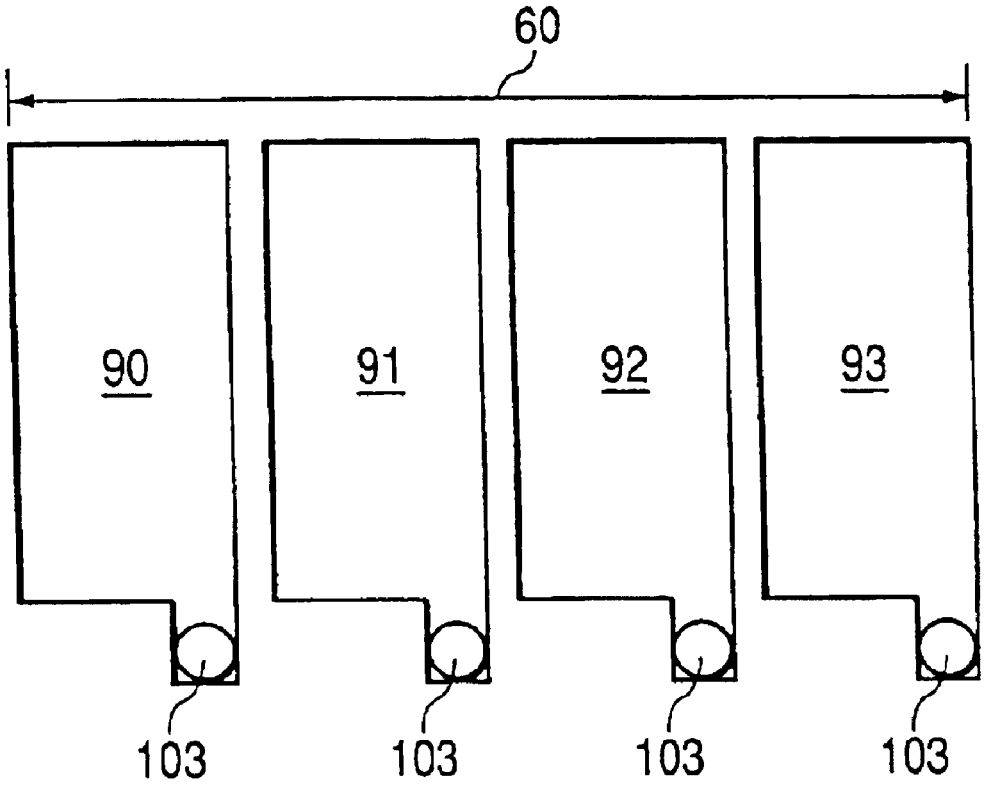
FIG. 21 RELATED ART
FIG. 21 is a diagram for representing the array of the fluid jetting device conceived from the fluid jetting device according to the related art.

| (1) Number "N1" of chambers | (2) Number "N2" of chambers | | (4) minimum unit device width (mm) D1 | | | (5) minimum unit device height (mm) D2 | | | (6) D2/D1 | |
|---|---|---|---|---|---|---|---|---|---|---|
| in a head scanning direction | in a paper feeding direction | (3) N2/N1 | case of FIG. 5 | case of FIG. 21 | improved amount (mm) | case of FIG. 5 | case of FIG. 21 | improved amount (mm) | case of FIG. 5 | case of FIG. 21 |
| 16 | 16 | 1 | 10.1 | 12.0 | 1.9 | 8.6 | 12.0 | 3.2 | 0.85 | 1.0 |
| 14 | 19 | 1.4 | 8.7 | 11.0 | 2.3 | 12.1 | 16.4 | 4.3 | 1.4 | 1.49 |
| 12 | 22 | 1.8 | 7.4 | 9.9 | 2.5 | 15.5 | 20.8 | 5.3 | 2.1 | 2.1 |
| 10 | 26 | 2.6 | 6.2 | 9.1 | 2.9 | 22.4 | 29.7 | 6.8 | 3.6 | 3.3 |
| 8 | 32 | 4 | 5.0 | 8.4 | 3.4 | 27.6 | 36.1 | 8.5 | 5.5 | 4.3 |
| 6 | 43 | 7.1 | 3.7 | 7.8 | 1.0 | 37.0 | 47.2 | 10.2 | 10 | 6.1 |

The table 4 indicates along a lateral direction:

(1) a total number "N1" of the chambers 102 along the head scanning direction "A";

(2) a total number "N2" of the chambers 102 along the paper transport direction "B";

(3) a ratio "N2/N1" of the pressure chamber quantity "N1" to the pressure chamber quantity "N2";

(4) an device length (will be referred to as "minimum unit device width" hereinafter) "D1" (mm) of the fluid jetting device 100 corresponding to a minimum unit device thereof along the head scanning direction "A";

(5) an device length (will be referred to as "minimum unit device height" hereinafter) "D2" (mm) of the fluid jetting device 100 corresponding to a minimum unit device thereof along the paper transport direction "B"; and (6) a ratio "D2/D1" of the minimum unit device length "D1" to the minimum unit device height "D2." Also, the table 4 indicates along a longitudinal direction numeral values described in the above-explained items (1) to (6) in the respective structural examples.

In the table 4, (1) the pressure chamber quantity "N1" is changed between 16 and 6, and (2) the pressure chamber quantity "N2" is changed between 16 and 43 in correspondence with the above-described numeral change. Since (1) the pressure chamber quantity "N1" is changed and (2) the pressure chamber quantity "N2" is changed, (3) the ratio "N2/N1" is changed between 1 and 7.1. In the respective structural examples, total numbers of the pressure chambers contained in the ink jetting head (unit device) are nearly equal to 260.

In correspondence with the change in (3) the ratio "N2/N1" of the pressure chamber quantity "N1" to the pressure chamber quantity "N2", (4) the minimum unit device width "D1" is changed between 10.1 and 3.7 (mm) in the structural example of the present invention shown in FIG. 9, whereas the minimum unit device width "D1" is changed between 12.0 and 7.8 (mm) in the conventional structural example of FIG. 27. In correspondence with these changes, an improvement amount (mm) is changed between 1.9 and 4.1, while this improvement amount corresponds to a difference between the minimum unit device width "D1" in the conventional structural example of FIG. 27, and also in the minimum unit device width "D1" in the structural example of the present invention shown in FIG. 9.

Also, in correspondence with the change in (3) the ratio "N2/N1" of the pressure chamber quantity "N1" to the pressure chamber quantity "N2", (5) the minimum unit device height "D2" is changed between 8.6 and 37.0 (mm) in the structural example of the present invention shown in FIG. 9, whereas the minimum unit device height "D2" is changed between 12.0 and 47.2 (mm) in the conventional structural example of FIG. 27. In correspondence with these changes, an improvement amount (mm) is changed between 3.2 and 10.2, while this improvement amount corresponds to a difference between the minimum unit device height "D2" in the conventional structural example of FIG. 27, and also in the minimum unit device height "D2" in the structural example of the present invention shown in FIG. 9.

In response to the changes of (4) the minimum unit device width "D1" and (5) to the minimum unit device height "D2", (6) the ratio "D2/D1" is changed between 0.85 and 10 in the structural example of the present invention shown in FIG. 9, and is changed between 1.0 to 6.1 in the conventional structural example of FIG. 27.

From the table 4, the following fact may be understood: In the structural example shown in FIG. 9, the values of the minimum unit device widths "D1" and the values of the minimum unit device heights "D2" are smaller than those of the conventional structural example shown in FIG. 27 in the respective cases. That is, since the present invention is applied to the fluid jetting device, both the minimum unit device width "D1" and the minimum unit device height "D2" can be decreased.

Also, from the table 4, it can be seen that the improvement amount of (4) the minimum unit device width "D1" is decreased in conjunction with the increase in (1) the pressure chamber quantity "N1" along the head scanning direction "A." This fact may be interpreted in the qualitative analysis as follows: When (1) the total number "N1" of the chambers 102 along the head scanning direction "A" is increased, since the total number of the sub-streams 105 is increased in the structural example of the present invention shown in FIG. 9, the effect of decreasing the unit device width by that the main stream 106 is extended along the head scanning direction "A" may be deteriorated due to the increase in the unit device width caused by increasing a total number of these sub-streams 105.

Furthermore, it can be understood that the improvement amount of the minimum unit device height is increased in conjunction of the increase in (2) the pressure chamber number "N2" along the paper transport direction "B", while this improvement amount is equal to the difference between the minimum unit device height "D2" in the conventional structural example of FIG. 27 and the minimum unit device height "D2" in the structural example of the present invention shown in FIG. 9. This fact may be interpreted as follows: That is, when (2) the pressure chamber number "N2" along the paper transport direction "B" is increased, a total number of the sub-streams 105 along the paper transport direction "B" is increased in the conventional structural example of FIG. 27, so that the minimum unit device height "D2" is increased.

As previously explained, in the embodiments according to the present invention, the ratio "N2/N1" of (1) the pressure chamber quantity "N1" arrayed along the head scanning direction "A" to (2) the pressure chamber quantity "N2" arrayed along the paper transport direction "B" is set to be larger than, or equal to 1, and smaller than, or equal to 7.1. As a result, when the fluid jetting device having such a structure is applied to the fluid jetting head, such a head structure having the narrow head width along the head scanning direction "A" can be obtained. Furthermore, in the fluid jetting apparatus to which this fluid jetting head is applied, it is possible to avoid a bulky fluid jetting apparatus, and since the head weight is decreased, the inertia force occurred while the fluid jetting head is operated may be decreased. Therefore, vibrations and noise of the fluid jetting apparatus can be reduced, and also, the positioning precision of the fluid jetting head can be improved.

Also, in the embodiment according to the present invention, since the ratio "D2/D1" of the minimum unit device width (device length) "D1" along the head scanning direction "A" to the minimum unit device height (device height) "D2" along the paper transport direction "B" is set to be larger than, or equal to 0.85, and smaller than, or equal to 10, such a head structure having the narrow head width along the head scanning direction "A" can be obtained similar to the above-described embodiment.

While the present invention has been described based upon the preferred embodiments thereof, the fluid jetting device, the fluid jetting head, and the fluid jetting apparatus, according to the present invention, are not limited only to the above-explained structures of these embodiments.

Therefore, fluid jetting devices, fluid jetting heads, and fluid jetting apparatus, to which various modifications and various changes have been applied, may be involved in the technical scope and spirit of the present invention.

As previously described in detail, the fluid jetting device, according to the present invention, is equipped with a plurality of fluid pool sub-streams for supplying the fluids to a plurality of chambers, the fluid pool main stream which is formed by jointing the single side of these plural fluid pool sub-streams, and the fluid supplying means for supplying a predetermined fluid to the fluid pool main steam. Since the fluid jetting device owns such a structure capable of connecting this fluid supplying means to the flow path in the vicinity of the center portion of the fluid pool main stream, or to the respective flow paths of the fluid pool main stream, the compact fluid jetting head can be obtained, and also, the more compact fluid jetting apparatus containing this compact fluid jetting head can be realized.

Also, since the fluid jetting device, according to the present invention, is arranged by that the plural sets of fluid pool main streams and the plural sets of fluid supplying means connected to these fluid pool main streams are provided, these plural fluid pool main streams are connected to the respective fluid pool sub-streams, the substantial flow paths of the fluids in the main streams can be shortened, and also, the fluids can be smoothly supplied to the plural chambers connected to the fluid pool sub-streams.

Furthermore, since the fluid jetting head can be made compact, the weight of this fluid jetting head can be decreased, and therefore, the inertia force produced while the fluid jetting head is driven can be decreased. As a result, both vibrations and noise of the fluid jetting apparatus containing this fluid jetting head can be reduced.

In particular, since the dimension of the fluid jetting head along the main scanning direction can be made compact, the lateral width of the fluid jetting apparatus containing this fluid jetting head can be made narrow. As a result, the fluid jetting apparatus itself can be made compact. In connection with this fact, the positioning precision of the fluid jetting head can be improved, and also, the jetting/applying position can be correctly controlled.

What is claimed is:

1. A fluid jetting device for jetting fluid droplets onto a subject to be fluid-jetted, the fluid jetting device comprising:

a fluid pool;

a plurality of chambers arranged in a matrix form and communicating to the fluid pool;

a nozzle formed in each of the plurality of chambers, the nozzle for jetting the fluid droplets onto the subject;

a fluid supplying portion for supplying the fluid to the fluid pool; and a plurality of fluid pressure applying portion for driving each of chambers, wherein the fluid pool includes:

a first flow path elongating along a first direction and disposed in the vicinity of the fluid supplying portion; and a plurality of second flow paths branching off from the first fluid path and elongating in a second direction perpendicular to the first fluid path;

wherein the first fluid path is connected to both end portions of each of second fluid paths; and wherein the second fluid paths are divided at a substantially center portion thereof.

2. The fluid jetting device according to claim 1, wherein a connection portion between the first fluid path and the fluid supplying portion is located in the vicinity of a center portion of the first flow path in the first direction.

3. The fluid jetting device according to claim 1, wherein a ratio "N2/N1" of number "N1" of the chambers arrayed in the first direction to number "N2" of the chambers arrayed in the second direction is not smaller than 1.

4. The fluid jetting device according to claim 1, wherein a ratio "D2/D1" of a device length "D1" in the first direction to a device length "D2" in the second direction is not smaller than 0.85.

5. The fluid jetting device according to claim 1, wherein the first flow path includes fluid streams, which are directed opposite to each other along the first flow path, while a connection portion between the fluid supplying portion and the first flow path is defined as a starting point of the fluid streams.

6. The fluid jetting device according to claim 2, wherein a flow path width of the first flow path is not uniform; and wherein the connection portion is arranged so that the connection portion is shifted to narrower flow path width side from a portion in the vicinity of the center portion of the first flow path.

7. The fluid jetting device according to claim 1, wherein a position of an n-th (symbol "n" being positive integer) chamber from a side in proximity to the first flow path in one of the second flow paths is shifted with respect to a position of the n-th chamber in another of the second flow paths located adjacent to the one of second flow paths in the second direction.

8. The fluid jetting device according to claim 7, wherein a shift amount between the one of second flow paths and another of the second flow paths corresponds to "p" dots (symbol "p" being positive integer) during a printing operation in case that the fluid jetting device is mounted on an ink jetting head.

9. The fluid jetting device according to claim 1, wherein the fluid supplying portion is connected to an end portion of the first flow path.

10. A fluid jetting device for jetting fluid droplets onto a subject to be fluid-jetted, the fluid jetting device comprising:

a fluid pool;

a plurality of chambers arranged in a matrix form and communicating to the fluid pool;

a nozzle formed in each of the plurality of chambers, the nozzle for jetting the fluid droplets onto the subject;

a fluid supplying portion for supplying the fluid to the fluid pool; and a plurality of fluid pressure applying portion for driving each of chambers, wherein the fluid pool includes:

a first flow path elongating along a first direction and disposed in the vicinity of the fluid supplying portion; and a plurality of second flow paths branching off from the first fluid path and elongating in a second direction perpendicular to the first fluid path; and wherein the first fluid path is connected to both end portions of each of second fluid paths.

11. The fluid jetting device according to claim 10, wherein a connection portion between the first fluid path and the fluid supplying portion is located in the vicinity of a center portion of the first flow path in the first direction.

12. The fluid jetting device according to claim 10, wherein a ratio "N2/N1" of number "N1" of the chambers arrayed in the first direction to number "N2" of the chambers arrayed in the second direction is not smaller than 1.

13. The fluid jetting device according to claim 10, wherein a ratio "D2/D1" of a device length "D1" in the first direction to a device length "D2" in the second direction is not smaller than 0.85.

14. The fluid jetting device according to claim 10, wherein the first flow path includes fluid streams, which are directed opposite to each other along the first flow path, while a connection portion between the fluid supplying portion and the first flow path is defined as a starting point of the fluid streams.

15. The fluid jetting device according to claim 11, wherein a flow path width of the first flow path is not uniform; and wherein the connection portion is arranged so that the connection portion is shifted to narrower flow path width side from a portion in the vicinity of the center portion of the first flow path.

16. The fluid jetting device according to claim 10, wherein a position of an n-th (symbol "n" being positive integer) chamber from a side in proximity to the first flow path in one of the second flow paths is shifted with respect to a position of the n-th chamber in another of the second flow paths located adjacent to the one of second flow paths in the second direction.

17. The fluid jetting device according to claim 16, wherein a shift amount between the one of second flow paths and another of the second flow paths corresponds to "p" dots (symbol "p" being positive integer) during a printing operation in case that the fluid jetting device is mounted on an ink jetting head.

18. The fluid jetting device according to claim 10, wherein the fluid supplying portion is connected to an end portion of the first flow path.

19. A fluid jetting device for jetting fluid droplets onto a subject to be fluid-jetted, the fluid jetting device comprising:

a fluid pool;

a plurality of chambers arranged in a matrix form and communicating to the fluid pool;

a nozzle formed in each of the plurality of chambers, the nozzle for jetting the fluid droplets onto the subject;

a fluid supplying portion for supplying the fluid to the fluid pool; and a plurality of fluid pressure applying portion for driving each of chambers, wherein the fluid pool includes:

a first flow path elongating along a first direction and disposed in the vicinity of the fluid supplying portion; and a plurality of second flow paths branching off from the first fluid path and elongating in a second direction perpendicular to the first fluid path; and wherein a ratio "N2/N1" of number "N1" of the chambers arrayed in the first direction to number "N2" of the chambers arrayed in the second direction is not smaller than 1.

* * * * *